US011842691B2

(12) United States Patent
Park et al.

(10) Patent No.: US 11,842,691 B2
(45) **Date of Patent: *Dec. 12, 2023**

(54) DISPLAY DEVICE INCLUDING DISTRIBUTED DRIVERS

(71) Applicant: SAMSUNG DISPLAY CO., LTD., Yongin-si (KR)

(72) Inventors: Yong Sung Park, Yongin-si (KR); Dae Hyun Noh, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/083,646

(22) Filed: Dec. 19, 2022

(65) Prior Publication Data

US 2023/0138496 A1 May 4, 2023

Related U.S. Application Data

(63) Continuation of application No. 16/952,832, filed on Nov. 19, 2020, now Pat. No. 11,532,275.

(30) Foreign Application Priority Data

Apr. 21, 2020 (KR) ..... 10-2020-0048138

(51) Int. Cl.
*G09G 5/00* (2006.01)
*G09G 3/3266* (2016.01)
(Continued)

(52) U.S. Cl.
CPC ..... *G09G 3/3266* (2013.01); *G09G 3/32* (2013.01); *G09G 3/3233* (2013.01);
(Continued)

(58) Field of Classification Search
CPC ..... G09G 3/3266; G09G 3/32; G09G 3/3233; G09G 3/3241; G09G 3/3275;
(Continued)

(56) References Cited

U.S. PATENT DOCUMENTS 7,714,817 B2 5/2010 Park et al.
10,192,938 B2 1/2019 Yu et al.
(Continued)

FOREIGN PATENT DOCUMENTS

CN 110619840 12/2019
KR 10-1169053 7/2012
(Continued)

*Primary Examiner* — Adam J Snyder
(74) *Attorney, Agent, or Firm* — F. Chau & Associates, LLC

(57) ABSTRACT

A display device including: first pixels connected to a first write line and a first compensation line; second pixels connected to a second write fine and a second compensation line; third pixels connected to a third write line and a third compensation line; fourth pixels connected to a fourth write line and a fourth compensation line; fifth pixels connected to a fifth write line and a fifth compensation line; sixth pixels connected to a sixth write line and a sixth compensation line; seventh pixels connected to a seventh write line and a seventh compensation line; and eighth pixels connected to an eighth write line and an eighth compensation line, the first to fourth compensation lines are connected to a first node, the fifth and sixth compensation lines are connected to a second node, the seventh and eighth compensation lines are connected to a third node.

17 Claims, 12 Drawing Sheets

(51) Int. Cl.

| | |
|---|---|
| *G09G 3/3233* | (2016.01) |
| *G09G 3/3275* | (2016.01) |
| *G09G 3/32* | (2016.01) |
| *G09G 3/3241* | (2016.01) |
| *G09G 3/36* | (2006.01) |

(52) U.S. Cl.
CPC ..... *G09G 3/3241* (2013.01); *G09G 3/3275* (2013.01); *G09G 3/3677* (2013.01); *G09G 2300/0408* (2013.01); *G09G 2300/0426* (2013.01); *G09G 2300/0439* (2013.01); *G09G 2300/0809* (2013.01); *G09G 2300/0819* (2013.01); *G09G 2300/0861* (2013.01); *G09G 2310/0202* (2013.01); *G09G 2310/0216* (2013.01); *G09G 2310/0218* (2013.01); *G09G 2310/0251* (2013.01); *G09G 2310/0262* (2013.01); *G09G 2310/0286* (2013.01); *G09G 2310/08* (2013.01); *G09G 2320/0223* (2013.01); *G09G 2320/045* (2013.01); *G09G 2340/0435* (2013.01)

(58) Field of Classification Search
CPC ..... G09G 3/3677; G09G 2300/0408; G09G 2300/0426; G09G 2300/0439; G09G 2300/0809; G09G 2310/0202; G09G 2310/0286; G09G 2310/08; G09G 2310/0223; G09G 2310/0216; G09G 2310/0218; G09G 2300/0819; G09G 2300/0861; G09G 2310/0251; G09G 2310/0262; G09G 2320/045; G09G 2340/0435
See application file for complete search history.

(56) References Cited

U.S. PATENT DOCUMENTS

| | | | | |
|---|---|---|---|---|
| 11,532,275 | B2 * | 12/2022 | Park | G09G 3/3266 |
| 2009/0021509 | A1 * | 1/2009 | Lee | G09G 3/3677 345/213 |
| 2011/0102389 | A1 * | 5/2011 | Park | G06F 3/0412 345/205 |
| 2013/0201172 | A1 | 8/2013 | Jeong et al. | |
| 2015/0002560 | A1 | 1/2015 | Kwon et al. | |
| 2017/0092200 | A1 | 3/2017 | Park et al. | |
| 2017/0337876 | A1 | 11/2017 | Kim et al. | |
| 2019/0005884 | A1 | 1/2019 | Yoo | |
| 2019/0096330 | A1 | 3/2019 | Kim et al. | |
| 2019/0096335 | A1 | 3/2019 | Kim et al. | |
| 2019/0109184 | A1 | 4/2019 | Li et al. | |
| 2019/0304356 | A1 | 10/2019 | Ka et al. | |
| 2019/0304366 | A1 | 10/2019 | Ka et al. | |
| 2020/0168141 | A1 | 5/2020 | Ma et al. | |
| 2021/0134202 | A1 | 5/2021 | Zhang et al. | |
| 2021/0327361 | A1 | 10/2021 | Park et al. | |

FOREIGN PATENT DOCUMENTS

| | | |
|---|---|---|
| KR | 10-2016-0031679 | 3/2016 |
| KR | 10-2019-0034375 | 4/2019 |
| KR | 10-2019-0114066 | 10/2019 |

* cited by examiner

DISPLAY DEVICE INCLUDING DISTRIBUTED DRIVERS

This application is a continuation of U.S. patent application Ser. No. 16/952,832 filed on Nov. 19, 2020, which claims priority under 35 U.S.C. § 119 to Korean Patent Application No. 10-2020-0048138, filed on, Apr. 21, 2020, the disclosures of which are incorporated by reference herein in their entireties.

1. TECHNICAL FIELD

The inventive concept relates to a display device.

2. DESCRIPTION OF THE RELATED ART

As information technology develops, a display device, which is a connection medium between a user and information, plays a major role in the absorption of information. Accordingly, use of a high quality display device such as a liquid crystal display device, an organic light emitting display device, or a plasma display device has been increasing.

The display device may be divided into a display area in which pixels are positioned and a non-display area in which pixels are not positioned. As the display area increases, the display device may display larger image. Therefore, a narrow bezel design in which the non-display area is reduced or a bezel-less design in which the non-display area is removed is being developed.

However, the non-display area still needs space for drivers for controlling the pixels and a load matching capacitor to compensate for a resistive-capacitive (RC) delay between signals.

SUMMARY

According to an exemplary embodiment of the inventive concept, there is provided a display device including: first pixels connected to a first write scan line and a first compensation scan line; second pixels connected to a second write scan line and a second compensation scan line; third pixels connected to a third write scan line and a third compensation scan line; fourth pixels connected to a fourth write scan line and a fourth compensation scan line; fifth pixels connected to a fifth write scan line and a fifth compensation scan line; sixth pixels connected to a sixth write scan line and a sixth compensation scan line; seventh pixels connected to a seventh write scan line and a seventh compensation scan line; and eighth pixels connected to an eighth write scan line and an eighth compensation scan line, the number of the first pixels is less than the number of the fifth pixels, the first compensation scan line, the second compensation scan line, the third compensation scan line, and the fourth compensation scan line are connected to a first node, the fifth compensation scan line and the sixth compensation scan line are connected to a second node, the seventh compensation scan line and the eighth compensation scan line are connected to a third node, and the first node, the second node, and the third node are different nodes.

The display device may further include: a first compensation stage having an output terminal connected to the first node; a second compensation stage connected to the first compensation stage through a first compensation carry line; a third compensation stage connected to the second compensation stage through a second compensation carry line, wherein the third compensation stage has an output terminal connected to the second node; and a fourth compensation stage connected to the third compensation stage through a third compensation carry line, wherein the fourth compensation stage has an output terminal connected to the third node.

The first write scan line, the second write scan line, the third write scan line, the fourth write scan line, the fifth write scan line, the sixth write scan line, the seventh write scan line, and the eighth write scan lines may be separated from each other.

The display device may further include: a first write stage having an output terminal connected to the first write scan line; a second write stage connected to the first write stage through a first write carry line, wherein the second write stage has an output terminal connected to the second write scan line; a third write stage connected to the second write stage through a second write carry line, wherein the third write stage has an output terminal connected to the third write scan line; a fourth write stage connected to the third write stage through a third write carry line, wherein the fourth write stage has an output terminal connected to the fourth write scan line; a fifth write stage connected to the fourth write stage through a fourth write carry line, wherein the fifth write stage has an output terminal connected to the fifth write scan line; a sixth write stage connected to the fifth write stage through a fifth write carry line, wherein the sixth write stage has an output terminal connected to the sixth write scan line; a seventh write stage connected to the sixth write stage through a sixth write carry line, wherein the seventh write stage has an output terminal connected to the seventh write scan line; and an eighth write stage connected to the seventh write stage through a seventh write carry line, wherein the eighth write stage has an output terminal connected to the eighth write scan line.

The display device may further include: a first initialization stage having an output terminal connected to the first pixels and the second pixels; a second initialization stage having an output terminal connected to the third pixels and the fourth pixels; a third initialization stage having an output terminal connected to the fifth pixels and the sixth pixels; and a fourth initialization stage having an output terminal connected to the seventh pixels and the eighth pixels.

The second initialization stage may be connected to the first initialization stage, the third initialization stage may be connected to the second initialization stage, and the fourth initialization stage may be connected to the third initialization stage.

The display device may further include: a first emission stage having an output terminal connected to the first pixels and the second pixels; a second emission stage having an output terminal connected to the third pixels and the fourth pixels; a third emission stage having an output terminal connected to the fifth pixels and the sixth pixels; and a fourth emission stage having an output terminal connected to the seventh pixels and the eighth pixels.

The second emission stage may be connected to the first emission stage, the third emission stage may be connected to the second emission stage, and the fourth emission stage may be connected to the third emission stage.

The display device may further include: a first bypass stage having an output terminal connected to the first pixels and the second pixels; a second bypass stage having an output terminal connected to the third pixels and the fourth pixels; a third bypass stage having an output terminal connected to the fifth pixels and the sixth pixels; and a fourth bypass stage having an output terminal connected to the seventh pixels and the eighth pixels.

The second bypass stage may be connected to the first bypass stage, the third bypass stage may be connected to the second bypass stage, and the fourth bypass stage may be connected to the third bypass stage.

A first pixel, which is one of the first pixels may include: a first transistor including a first electrode, a second electrode, and a gate electrode; a second transistor having a first electrode connected to a data line, a second electrode connected to the first electrode of the first transistor, and a gate electrode connected to the first write scan line; and a third transistor having a first electrode connected to the second electrode of the first transistor, a second electrode connected to the gate electrode of the first transistor, and a gate electrode connected to the first compensation scan line.

The first pixel may further include: a fourth transistor having a first electrode connected to a first initialization line, a second electrode connected to the gate electrode of the first transistor, and a gate electrode connected to a first initialization scan line, wherein the first initialization scan line connects the first initialization stage to the first pixels; a fifth transistor having a first electrode connected to a first power line, a second electrode connected to the first electrode of the first transistor, and a gate electrode connected to a first emission scan line, wherein the first emission scan line connects the first emission stage to the first pixels; a sixth transistor having a first electrode connected to the second electrode of the first transistor, a second electrode, and a gate electrode connected to the first emission scan line; a capacitor having a first electrode connected to the first power line, and a second electrode connected to the gate electrode of the first transistor; and a light emitting diode having an anode connected to the second electrode of the sixth transistor and a cathode connected to a second power line.

The first pixel may further include: a seventh transistor having a first electrode connected to the anode of the light emitting diode, a second electrode connected to a second initialization line, and a gate electrode connected to the first bypass scan line, wherein the first bypass scan line connects the first bypass stage to the first pixels; and an eighth transistor having a first electrode connected to a third power line, a second electrode connected to the first electrode of the first transistor, and a gate electrode connected to the first bypass scan line.

The first initialization stage may apply an initialization scan signal of a turn-on level to a first initialization scan line and a second initialization scan line during a first period, wherein the first initialization scan line connects the first initialization stage to the first pixels and the second initialization scan line connects the first initialization stage to the second pixels, and the first compensation stage may apply a compensation scan signal of the turn-on level to the first compensation scan line, the second compensation scan line, the third compensation scan line, and the fourth compensation scan line during a second period after the first period.

The third compensation stage may apply a compensation scan signal of the turn-on level to the fifth compensation scan line and the sixth compensation scan line during a third period, and the first write stage, the second write stage, the third write stage, and the fourth write stage may sequentially output write scan signals of the turn-on level during a period other than the third period within the second period.

The fourth compensation stage may apply a compensation scan signal of the turn-on level to the seventh compensation scan line and the eighth compensation scan line during a fourth period, the fifth write stage and the sixth write stage may sequentially output write scan signals of the turn-on level during a period other than the fourth period within the third period, and the seventh write stage and the eighth write stage may sequentially output write scan signals of the turn-on level during the fourth period.

The first emission stage may apply an emission scan signal of a turn-off level to a first emission scan line and a second emission scan line during a fifth period, wherein the first emission scan line connects the first emission stage to the first pixels and the second emission scan line connects the first emission stage to the second pixels, the fifth period includes the first period and the second period, the first bypass stage may apply a bypass scan signal of the turn-on level to a first bypass scan line and a second bypass scan line during a sixth period, wherein the first bypass scan line connects the first bypass stage to the first pixels and the second bypass scan line connects the first bypass stage to the second pixels, the sixth period may overlap the fifth period and may not overlap the first period and the second period, and a period in which the second period and the third period overlap may be shorter than a period in which the third period and the fourth period overlap.

According to an exemplary embodiment of the inventive concept, there is provided a display device including: first pixels connected to a first write scan line and a first compensation scan line, wherein the first pixels are located in a first pixel area having a first width; and second pixels connected to a second write scan line and a second compensation scan line, wherein the second pixels are located in a second pixel area having a second width greater than the first width, wherein the second compensation scan line is connected to the second pixels arranged in v horizontal lines, wherein vis an integer greater than 0, and the first compensation scan line is connected to the first pixels arranged in u horizontal lines, wherein u is greater than v.

The display device may further include: third pixels connected to the first write scan line and the first compensation scan line, wherein the third pixels are located in a third pixel area having a third width less than the second width.

According to an exemplary embodiment of the inventive concept, there is provided a display device including: first pixels connected to a first scan line; second pixels connected to a second scan line adjacent to the first scan line; third pixels connected to a third scan line; and fourth pixels connected to a fourth scan line adjacent to the third scan line, wherein the number of the second pixels is different from the number of the third pixels, scan signals of a turn-on level supplied to the first scan line and the second scan line have the same phase, and scan signals of the turn-on level supplied to the third scan line and the fourth scan line have different phases.

According to an exemplary embodiment of the inventive concept, there is provided a display device including: a first pixel row connected to a first scan line, a second pixel row connected to a second scan line, a third pixel row connected to a third scan line and a fourth pixel row connected to a fourth scan line, wherein the first, second, third and fourth scan lines are connected to a first node; a fifth pixel row connected to a fifth scan line and a sixth pixel row connected to a sixth scan line, wherein the fifth and sixth scan lines are connected to a second node different from the first node; and a seventh pixel row connected to a seventh scan line and an eighth pixel row connected to an eighth scan line, wherein the seventh and eighth pixel rows are connected to a third node different from the second node.

The first node may be connected to a first compensation stage of a scan driver, the second node may be connected to a third compensation stage of the scan driver and the third node may be connected to a fourth compensation stage of the scan driver.

A second compensation stage of the scan driver may not be connected to the first node second node or third node.

The second compensation stage may be connected between the first compensation stage and the third compensation stage.

A number of pixels in the first pixel row may be less than a number of pixels in the fifth pixel row.

BRIEF DESCRIPTION OF THE DRAWINGS

The above and other features of the inventive concept will become more apparent by describing in further detail exemplary embodiments thereof with reference to the accompanying drawings, in which.

DETAILED DESCRIPTION OF THE EMBODIMENTS

Figure 1:
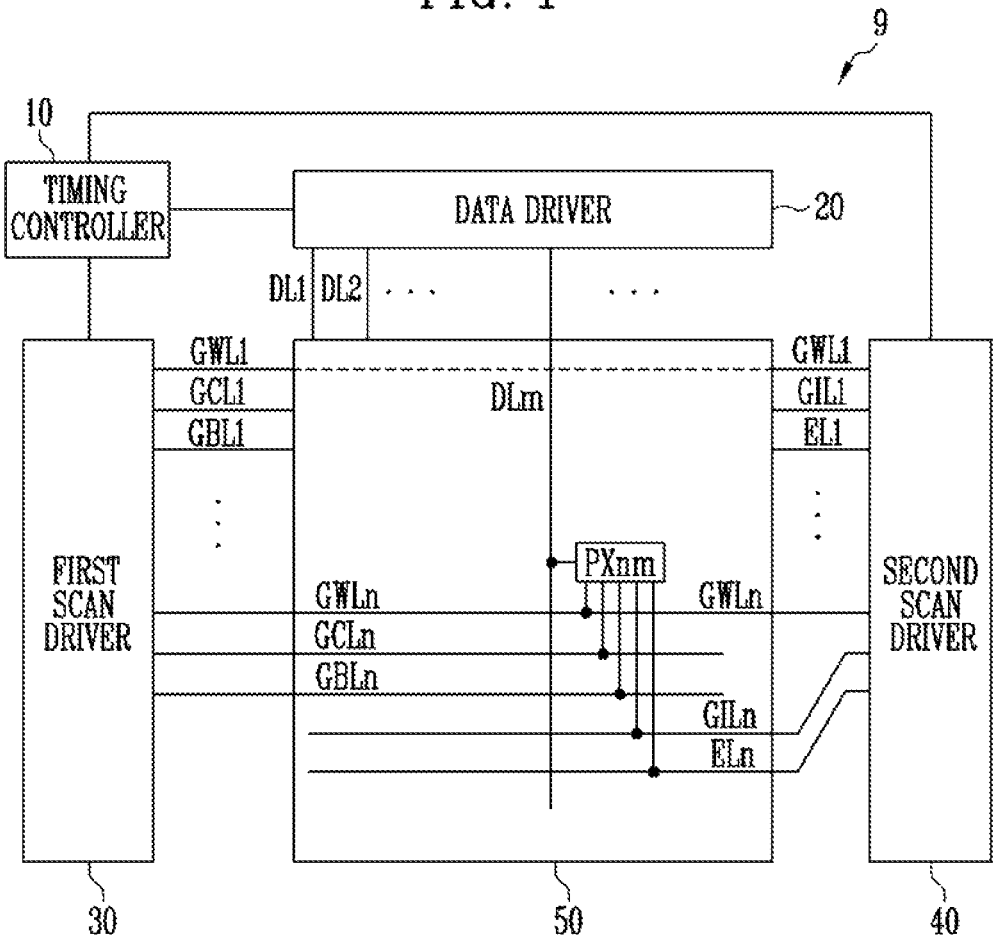
FIG. 1 is a diagram for describing a display device according to an exemplary embodiment of the inventive concept.

Hereinafter, exemplary embodiments of the inventive concept will be described in detail with reference to the accompanying drawings. It is to be understood, however, that the described embodiments may be implemented in various different ways, and thus, should not limited to the embodiments described herein. The embodiments disclosed herein may be used in combination with each other, or may be used independently of each other.

Throughout the specification like reference numerals may refer to like parts.

In addition, the sizes and thicknesses of elements shown in the drawings may be exaggerated for clarity of illustration.

FIG. 1 is a diagram for describing a display device according to an exemplary embodiment of the inventive concept.

Referring to FIG. 1, a display device 9 according to an exemplary embodiment of the inventive concept may include a timing controller 10, a data driver 20, a first scan driver 30, a second scan driver 40, and a pixel unit 50.

The timing controller 10 may receive an external input signal from an external processor. The external input signal may include a vertical synchronization signal, a horizontal synchronization signal, a data enable signal, and red, green, blue (RGB) data.

The vertical synchronization signal may include a plurality of pulses and may indicate that a previous frame period is ended and a current frame period is started based on a time point at which each of pulses is generated. An interval between adjacent pulses of the vertical synchronization signal may correspond to one frame period. For example, a first pulse of the vertical synchronization signal may indicate the start of a current frame period and a second pulse of the vertical synchronization signal may indicated the end of the current frame period. The horizontal synchronization signal may include a plurality of pulses and may indicate that a previous horizontal period is ended and a new horizontal period is started based on a time point at which each of the pulses is generated. An interval between adjacent pulses of the horizontal synchronization signal may correspond to one horizontal period. The data enable signal may indicate that the RGB data is supplied in the horizontal period. For example, the RGB data may be supplied in units of pixel rows in the horizontal periods in correspondence with the data enable signal. The timing controller 10 may generate grayscale values based on the RGB data to correspond to a specification of the display device 9. For example, the grayscale values may be RGB data rearranged in correspondence with resolution or the like of the pixel unit 50. The timing controller 10 may generate control signals to be supplied to the data driver 20, the first scan driver 30, the second scan driver 40, and the like based on the external input signal to correspond to the specifications of the display device 9.

The data driver 20 may generate data voltages to be provided to data lines DL1 DL2, and DLm using the grayscale values and the control signals received from the timing controller 10. For example, the data driver 20 may sample the grayscale values using a clock signal and may supply the data voltages corresponding to the grayscale values to the data lines DL1, DL2, and DLm in a pixel row (for example, pixels connected to the same write scan line) unit.

The first scan driver 30 may receive the control signals from the timing controller 10 and generate scan signals to be provided to scan lines GWL1, GCL1, GBL1, GWLn, GCLn, and GBLn. Here, n may be an integer greater than 0.

The first scan driver 30 may include a first write scan driver, a compensation scan driver, and a bypass scan driver. The first write scan driver may be a shift register, and may include a plurality of write stages connected to write carry lines. The write stages may sequentially generate write carry signals in correspondence with a write start signal received from the timing controller 10. In other words, the write stages may sequentially generate write carry signals in response to a write start signal. The write stages may sequentially generate write scan signals of a turn-on level according to the write start signal and the write carry signals. The write scan signals of the turn-on level may be provided to corresponding write scan lines GWL1 and GWLn.

The compensation scan driver may be a shift register, and may include a plurality of compensation stages connected to compensation carry lines. The compensation stages may sequentially generate compensation carry signals in correspondence with a compensation start signal received from the timing controller 10. In other words, the compensation stages may sequentially generate compensation carry signals in response to a compensation start signal. The compensation stages may sequentially generate compensation scan signals of a turn-on level according to the compensation start signal and the compensation carry signals. The compensation scan signals of the turn-on level may be provided to corresponding compensation scan lines GCL1 and GCLn.

The bypass scan driver may be a shift register, and may include a plurality of bypass stages connected to bypass carry lines. The bypass stages may sequentially generate bypass carry signals in correspondence with a bypass start signal received from the timing controller 10. In other words, the bypass stages may sequentially generate bypass carry signals in response to a bypass start signal. The bypass stages may sequentially generate bypass scan signals of a turn-on level according to the bypass start signal and the bypass carry signals. The bypass scan signals of the turn-on level may be provided to corresponding bypass scan lines GBL1 and GBLn.

The second scan driver 40 may receive the control signals from the timing controller 10 and generate scan signals to be provided to the scan lines GWL1, GIL1, EL1, GWLn, GILn, and ELn.

The second scan driver 40 may include a second write scan driver, an initialization scan driver, and an emission scan driver. The second write scan driver may be a shift register, and may include a plurality of write stages connected to write carry lines. The write stages may sequentially generate write carry signals in correspondence with a write start signal received from the timing controller 10. The write stages may sequentially generate write scan signals of a turn-on level according to the write start signal and the write carry signals. The write scan signals of the turn-on level may be provided to corresponding write scan lines GWL1 and GWLn.

The initialization scan driver may be a shift register, and may include a plurality of initialization stages connected to initialization carry lines. The initialization stages may sequentially generate initialization carry signals in correspondence with an initialization start signal received from the timing controller 10. In other words, the initialization stages may sequentially generate initialization carry signals in response to an initialization start signal. The initialization stages may sequentially generate initialization scan signals of a turn-on level according to the initialization start signal and the initialization carry signals. The initialization scan signals of the turn-on level may be provided to corresponding initialization scan lines GIL1 and GILn.

The emission scan driver may be a shift register, and may include a plurality of emission stages connected to emission carry lines. The emission stages may sequentially generate emission carry signals in correspondence with an emission stop signal received from the timing controller 10. In other words, the emission stages may sequentially generate emission carry signals in response to an emission stop signal. The emission stages may sequentially generate emission scan signals of a turn-off level according to the emission stop signal and the emission carry signals. The emission scan signals of the turn-off level may be provided to corresponding emission scan lines EL1 and ELn.

The pixel unit 50 includes pixels. For example, a pixel PXnm may be connected to corresponding data line DLm, write scan line GWLn, compensation scan line GCLn, bypass scan line GBLn, initialization scan line GILn, and emission scan line ELn.

According to the present embodiment, each of the write scan lines GWL1 and GWLn may be connected to the write stages of the first scan driver 30 and the write stages of the second scan driver 40 to receive the write scan signals from both sides of the pixel unit 50. Accordingly, a resistive-capacitive (RC) delay of the write scan signals may be minimized. Although the first scan driver 30 and the second scan driver 40 are shown at opposite sides of the pixel unit 50, in an alternative embodiment, the first scan driver 30 and the second scan driver 40 can be disposed under the pixel unit 50.

According to the present embodiment, the first scan driver 30 may include the compensation stages and bypass stages, and the second scan driver 40 may include the initialization stages and the emission stages. Accordingly, the stages necessary for control of the pixels may be distributed on both sides of the pixel unit 50, and thus a bezel size may be minimized.

Figure 2:
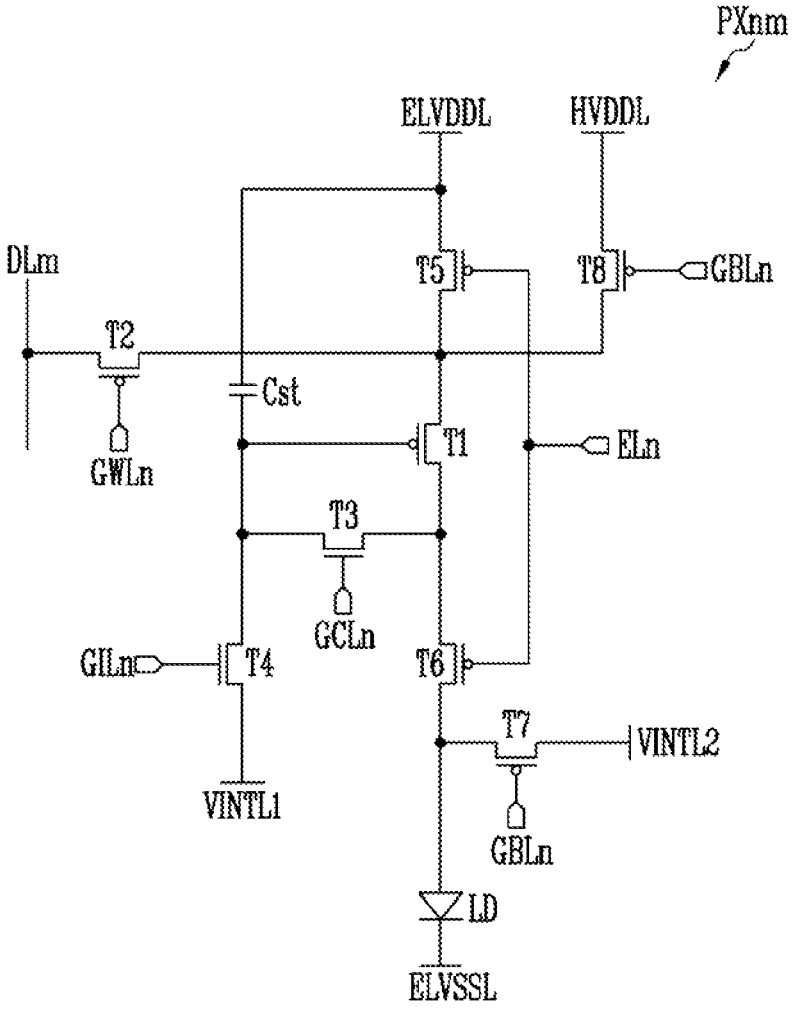
FIG. 2 is a diagram for describing a pixel according to an exemplary embodiment of the inventive concept.

FIG. 2 is a diagram for describing the pixel according to an exemplary embodiment of the inventive concept.

Referring to FIG. 2, the pixel PXnm may include transistors T1, T2, T3, T4, T5, T6, T7 and T8, a capacitor Cst, and a light emitting diode LD. The pixel PXnm is connected to an n-th write scan line GWLn and an m-th data line DLm. Since other pixels may have the same pixel circuit structure except for control lines connected thereto, a repetitive description thereof is omitted.

The first transistor T1 may include a first electrode, a second electrode, and a gate electrode. The first transistor T1 may be referred to as a driving transistor.

The second transistor T2 may have a first electrode connected to the data line DLm, a second electrode connected to the first electrode of the first transistor T1, and a gate electrode connected to the write scan line GWLn.

The third transistor T3 may have a second electrode connected to the gate electrode of the first transistor T1, a first electrode connected to the second electrode of the first transistor T1, and a gate electrode connected to the compensation scan line GCLn.

The fourth transistor T4 may have a second electrode connected to the gate electrode of the first transistor T1, a first electrode connected to a first initialization line VINTL1, and a gate electrode connected to the initialization scan line GILn.

The fifth transistor T5 may have a first electrode connected to a first power line ELVDDL, a second electrode connected to the first electrode of the first transistor T1, and a gate electrode connected to the emission scan line ELn.

The sixth transistor 16 may have a first electrode connected to the second electrode of the first transistor T1, a second electrode connected to the anode of the light emitting diode LD, and a gate electrode connected to the emission scan line ELn.

The seventh transistor T7 may have a first electrode connected to the anode of the light emitting diode LD, a second electrode connected to a second initialization line VINTL2, and a gate electrode connected to the bypass scan line GBLn.

The eighth transistor T8 may have a first electrode connected to a third power line HVDDL, a second electrode connected to the first electrode of the first transistor T1, and a gate electrode connected to the bypass scan line GBLn. According to an exemplary embodiment of the inventive concept, the first electrode of the eighth transistor T8 may be connected to the second electrode of the first transistor T1.

The capacitor Cst may have a first electrode connected to the first power line ELVDDL and a second electrode connected to the gate electrode of the first transistor T1.

The light emitting diode LD may have the anode connected to the second electrode of the sixth transistor T6 and the cathode connected to a second power line ELVSSL. The light emitting diode LD may be an organic light emitting diode, a quantum dot/well light emitting diode, or the like. In FIG. 2, one light emitting diode is shown. However, in another exemplary embodiment of the inventive concept, a plurality of light emitting diodes connected in series, parallel, or in series and parallel may be configured. For example, another light emitting diode may be connected in parallel to the light emitting diode LD between the first electrode of the seventh transistor T7 and the second power line ELVSSL.

Voltages applied to the first power line ELVDDL and the third power line HVDDL may be greater than voltages applied to the first initialization line VINTL1, the second initialization line VINTL2, and the second power line ELVSSL. A voltage applied to the third power line HVDDL may be greater than the voltage applied to the first power line ELVDDL.

The transistors T1, T2, T5, T6, T7, and T8 may be P-type transistors. For example, the transistors T1, T2, T5, T6, T7, and T8 may be P-channel metal oxide semiconductor (PMOS) transistors. For example, channels of the transistors T1, T2, T5, T6, T7, and T8 may be configured of poly silicon. A poly silicon transistor may be a low temperature poly silicon (LTPS) transistor. The poly silicon transistor has high electron mobility and thus the poly silicon transistor has a fast driving characteristic.

The transistors T3 and T4 may be N-type transistors. For example, the transistors T3 and T4 may be N-channel metal oxide semiconductor (NMOS) transistors. For example, channels of the transistors T3 and T4 may be configured of an oxide semiconductor. An oxide semiconductor transistor has low charge mobility in comparison with poly silicon. Therefore, an amount of leakage current generated in a turn-off state of the oxide semiconductor transistors is smaller than that of poly silicon transistors.

Figure 3:
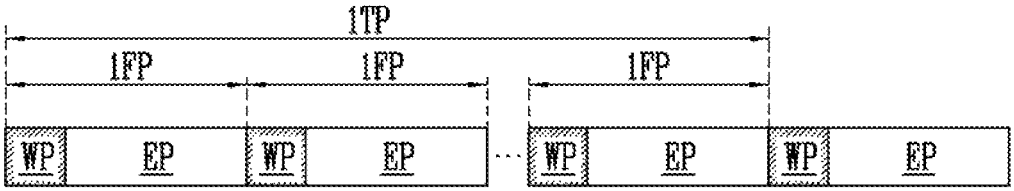
FIG. 3 is a diagram for describing a high frequency driving method according to an exemplary embodiment of the inventive concept.

FIG. 3 is a diagram for describing a high frequency driving method according to an exemplary embodiment of the inventive concept.

When the pixel unit 50 displays frames at a first driving frequency, the display device 9 may be in a first display mode. In addition, when the pixel unit 50 displays the frames at a second driving frequency less than the first driving frequency, the display device 9 may be in a second display mode.

In the first display mode, the display device 9 may display image frames at 20 Hz or more, for example, 60 Hz.

The second display mode may be a low power display mode. In this case, the display device 9 may display the image frames at less than 20 Hz, for example, 1 Hz. For example, a case where only the time and date are displayed in an "always on mode" may correspond to the second display mode.

A period 1TP in FIG. 3 is used to compare the first display mode and the second display mode. The period 1TP may be the same time interval in the first display mode and the second display mode.

In the first display mode, the period 1TP may include a plurality of frame periods 1FP. In the first display mode, each of the frame periods 1FP may sequentially include a data write period WP and an emission period EP.

Therefore, the pixel PXnm may display a plurality of image frames corresponding to the number of frame periods 1FP during the period 1TP, based on the data voltages received in the data write periods WP.

Figure 4:
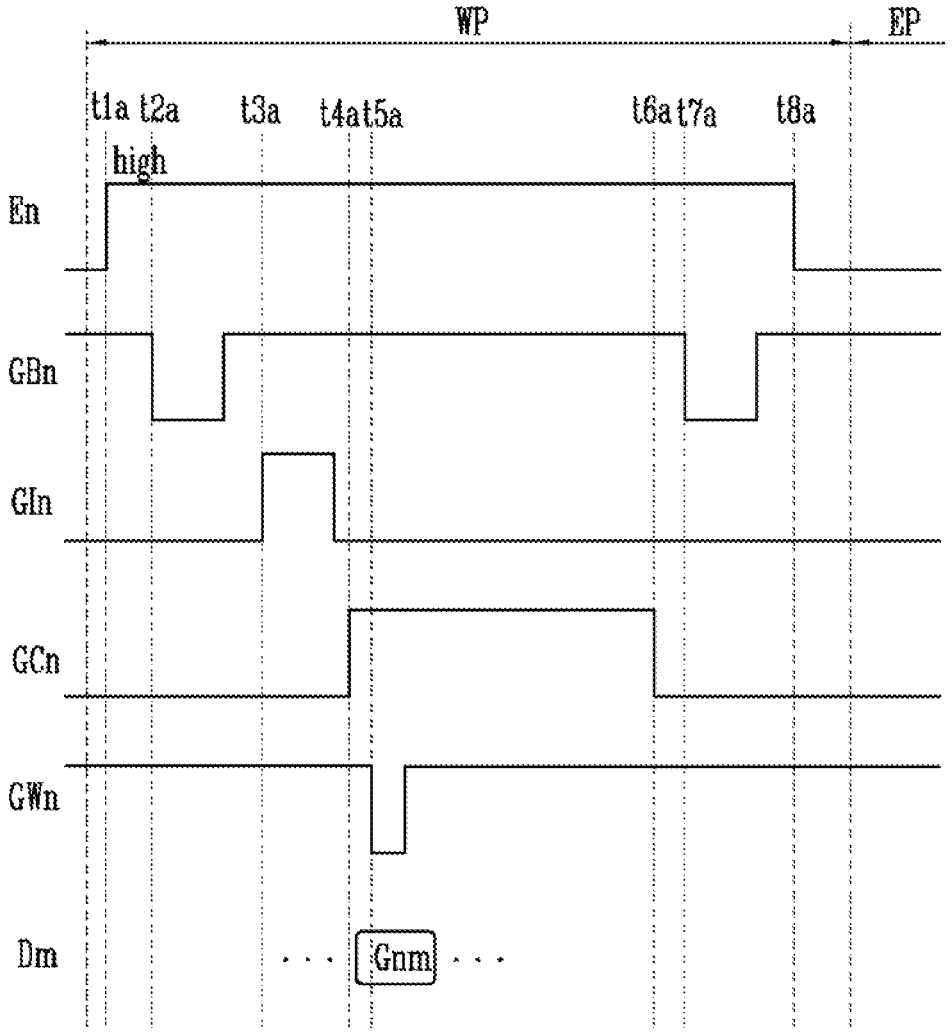
FIG. 4 is a diagram for describing a data write period according to an exemplary embodiment of the inventive concept.

FIG. 4 is a diagram for describing the data write period according to an exemplary embodiment of the inventive concept.

At a time point t1*a*, an emission scan signal En of a turn-off level is supplied to the emission scan line ELn. For example, the emission scan signal En transitions from a low level to a high level. Accordingly, the fifth and sixth transistors T5 and T6 are turned off, and a driving current flowing from the first power line ELVDDL to the second power line ELVSSL is cut off.

At a time point t2*a*, a bypass scan signal GBn of a turn-on level is supplied to the bypass scan line GBLn. For example, the bypass scan signal GBn transitions from a high level to a low level. Accordingly, the seventh and eighth transistors T7 and T8 are turned on. As the seventh transistor T7 is turned on, an initialization voltage of the second initialization line VINTL2 is applied to the anode of the light emitting diode LD. Accordingly, a voltage of the anode of the light emitting diode LD may be initialized. As the eighth transistor T8 is turned on, a power voltage of the third power line HVDDL is applied to the first electrode of the first transistor T1. Accordingly, the first transistor T1 may be on-biased by a voltage difference between the gate electrode and a source electrode (e.g., the first electrode) of the first transistor T1. Therefore, hysteresis due to a grayscale of a previous frame period may be prevented. In particular, since a power voltage of the third power line HVDDL is used as an on-bias voltage of the first transistor T1, rather than a data voltage of a previous horizontal period, the on-bias of the first transistor T1 may be guaranteed in all frame periods.

At a time point t3*a*, an initialization scan signal GIn of a turn-on level is supplied to the initialization scan line GILn. For example, the initialization scan signal GILn transitions from a low level to a high level. Accordingly, the fourth transistor T4 is turned on, and an initialization voltage of the first initialization line VINTL1 is applied to the gate electrode of the first transistor T1. Thus, a voltage of the gate electrode of the first transistor T1 is initialized.

At a time point t4*a*, a compensation scan signal GCn of a turn-on level is supplied to the compensation scan line GCLn. Accordingly, the third transistor T3 is turned on, and the first transistor T1 is connected in a diode form. At the time point t4*a*, the third transistor T3 may be turned on after the fourth transistor T4 is turned off.

At a time point t5*a*, a write scan signal GWn of a turn-on level is supplied to the write scan line GWn. Accordingly, the second transistor T2 is turned on. At this time, a data voltage Dm corresponding to the pixel PXnm may be applied to the data line DLm. A magnitude of the data voltage Dm may correspond to a grayscale value Gnm of the pixel PXnm. The data voltage Dm may be applied to the gate electrode of the first transistor T1 through the second transistor T2, the first transistor T1, and the third transistor T3 sequentially. At this time, the voltage applied to the gate electrode of the first transistor T1 is a compensated data voltage Dm including a decrease corresponding to a threshold voltage of the first transistor T1.

Even when a write scan signal GWn of a turn-off level is supplied, the first electrode of the first transistor T1 may maintain the data voltage Dm due to a parasitic capacitance. In other words, even when the write scan signal transitions high after the time point t5*a*, the first electrode of the first transistor T1 maintains the data voltage Dm. Therefore, the threshold voltage of the first transistor T1 may be compensated from the time point t5*a* to a time point t6*a*. At the time point t6*a*, a compensation scan signal GCn of a turn-off level is supplied to the compensation scan line GCLn.

At a time point t7*a*, a bypass scan signal GBn of a turn-on level is supplied to the bypass scan line GBn. Accordingly, the seventh and eighth transistors T7 and T8 are turned on. As the seventh transistor T7 is turned on, an initialization voltage of the second initialization line VINTL2 is applied to the anode of the light emitting diode LD. Accordingly, a voltage of the anode of the light emitting diode LD may be initialized. As the eighth transistor T8 is turned on, the power voltage of the third power line HVDDL is applied to the first electrode of the first transistor T1. Accordingly, the first transistor T1 may be on-biased by the voltage difference between the gate electrode and the source electrode (e.g., first electrode) of the first transistor T1. According to an exemplary embodiment of the inventive concept, the bypass scan signal GBn of the turn-on level may be supplied only at one of the time point t2*a* and the time point t7*a*.

Figure 5:
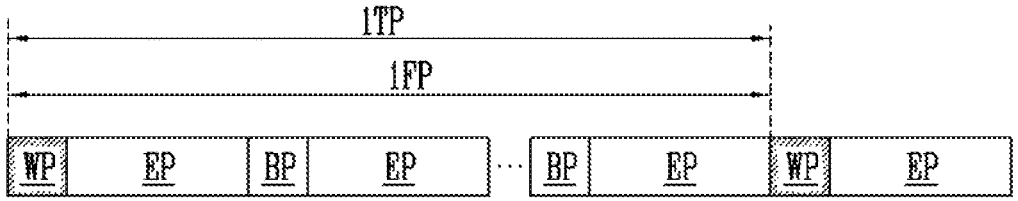
FIG. 5 is a diagram for describing a low frequency driving method according to an exemplary embodiment of the inventive concept.

FIG. 5 is a diagram for describing a low frequency driving method according to an exemplary embodiment of the inventive concept.

In the second display mode, a time interval of the period 1TP and one frame period 1FP may be the same. In the second display mode, each of the frame period 1FP may sequentially include a data write period WP, an emission period EP, a bias refresh period BP, and an emission period EP.

Since the third and fourth transistors T3 and T4 of the pixel PXnm maintain a turn-off state in the bias refresh periods BP, the capacitor Cst maintains the same data voltage during one frame period 1FP. In particular, since the third and fourth transistors T3 and T4 may be configured of the oxide semiconductor transistors, a leakage current may be minimized.

Accordingly, the pixel PXnm may display the same single image frame during the period 1TP based on the data voltage Dm received during the data write period WP.

Figure 6:
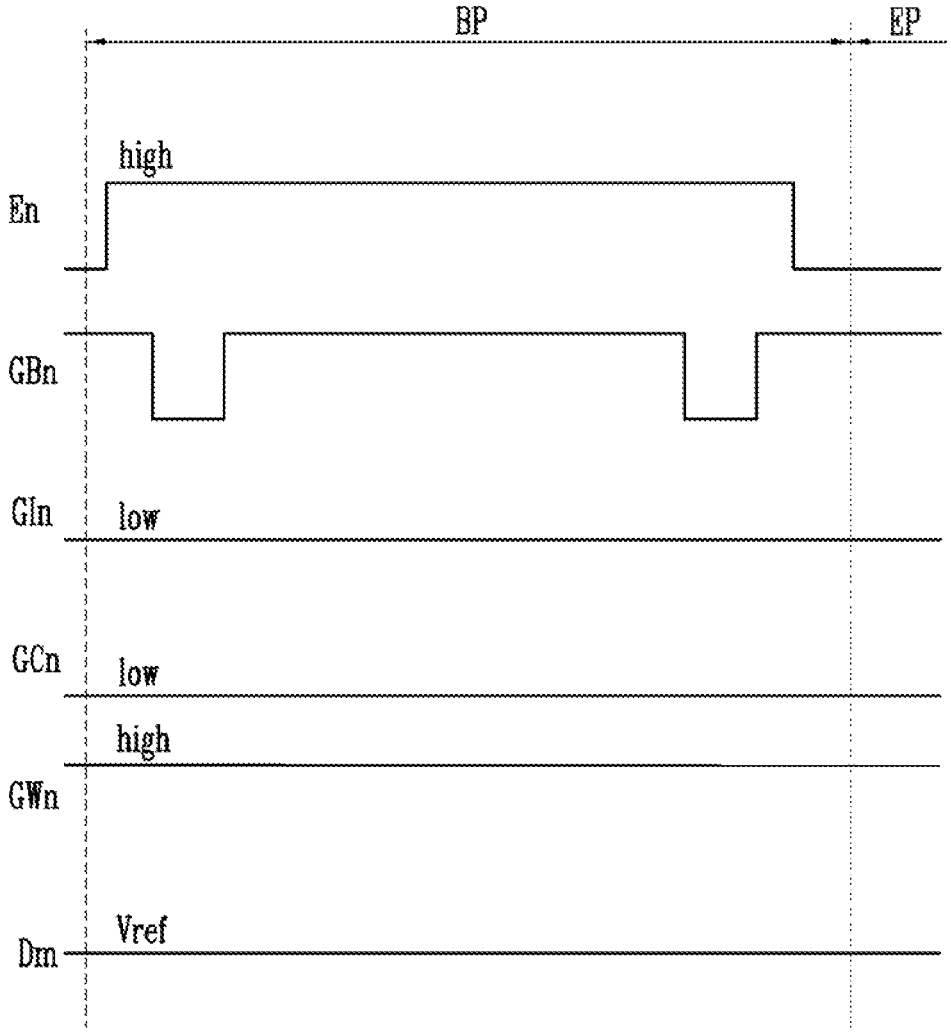
FIG. 6 is a diagram for describing a bias refresh period according to an exemplary embodiment of the inventive concept.

FIG. 6 is a diagram for describing the bias refresh period according to an exemplary embodiment of the inventive concept.

Referring to FIG. 6, waveforms of the emission scan signal En and the bypass scan signal GBn of the bias refresh period BP may be the same as waveforms of the emission scan signal En and bypass scan signal GBn of the data write period WP described above. Therefore, since an emission waveform of the light emitting diode LD during the low frequency driving is similar to that during the high frequency driving, flicker may not be recognized by a user.

However, the bias refresh period BP is different from the data write period WP in that the initialization scan signal GIn, the compensation scan signal GCn, and the write scan signal GWn maintain a turn-off level in the bias refresh period BP.

In the bias refresh period BP, the data voltage Dm may be maintained as a reference voltage Vref. For another example, the data voltage Dm may not be supplied, or may be supplied with a different voltage level regardless of a grayscale of the pixel PXnm.

The period 1TP in which the pixel unit 50 is driven in the first display mode may be referred to as a first period (see FIG. 3). The period 1TP in which the pixel unit 50 is driven in the second display mode may be referred to as a second period (see FIG. 5). In this case, time intervals of the first period and the second period may be the same.

The plurality of write stages may supply write scan signals of a turn-on level during a first period in a first cycle. For example, referring to FIGS. 3 and 4, the write scan signals of the turn-on level supplied may be proportional to the number of data write periods WP in the first period. The plurality of write stages may supply the write scan signals of the turn-on level during a second period in a second cycle. For example, referring to FIGS. 5 and 6, the scan signals of the turn-on level supplied may be proportional to the number of data write periods WP in the second period. The number of data write periods WP included in the second period is less than the number of data write periods WP included in the first period. Therefore, the first period is shorter than the second period.

Figure 7:
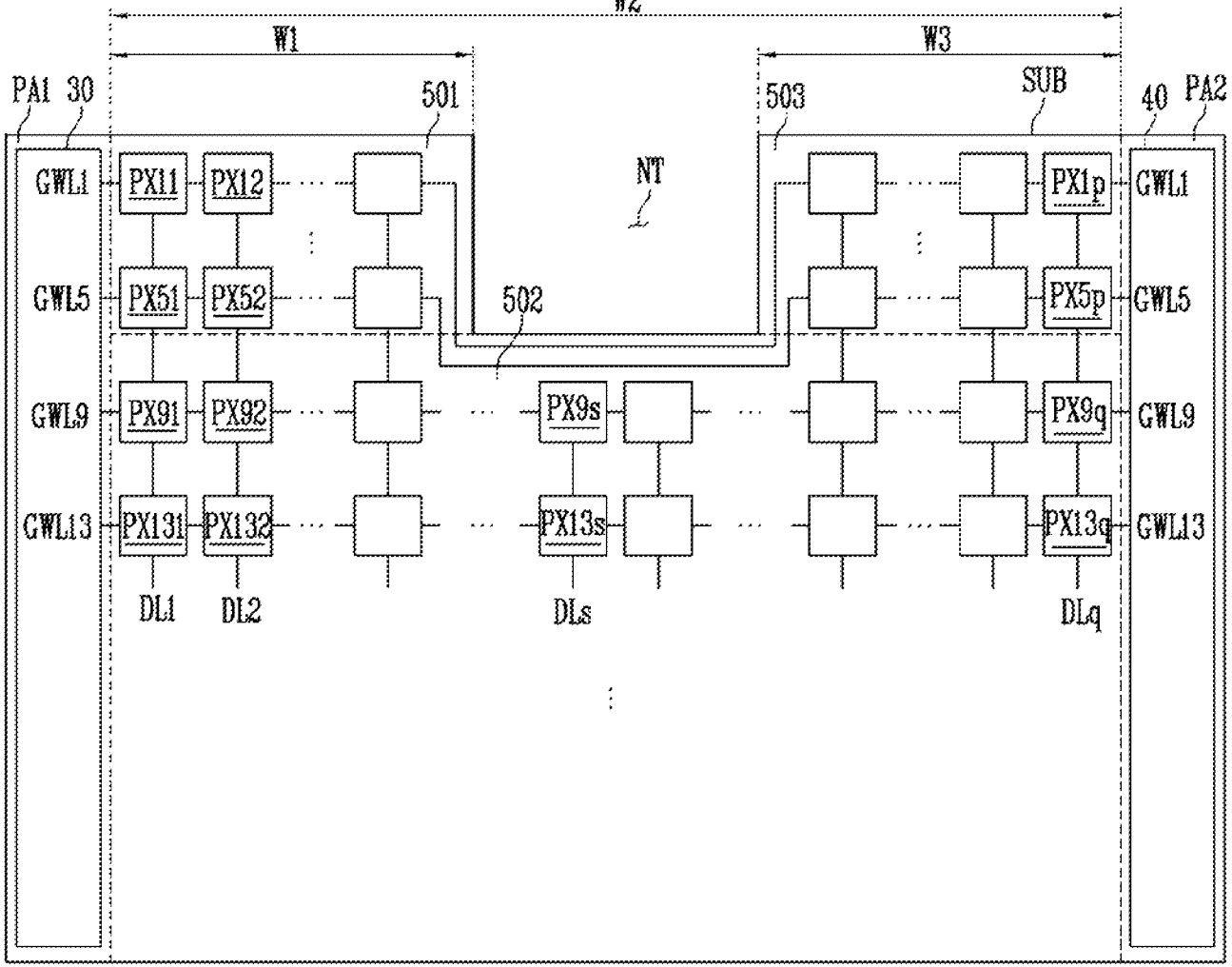
FIG. 7 is a diagram for describing a display device according to an exemplary embodiment of the inventive concept in which a substrate includes a notch.

FIG. 7 is a diagram for describing a display device according to an exemplary embodiment of the inventive concept in which the substrate includes a notch.

Referring to FIG. 7, a substrate SUB of the display device 9 may include the notch NT. The substrate SUB may include a first pixel area 501 positioned on a first side of the notch NT, a second pixel area 502 positioned on a second side of the notch NT, and a third pixel area 503 positioned on a third side of the notch NT. In addition, the substrate SUB may further include a first peripheral area PA1 positioned on an outer side the first pixel area 501 and the second pixel area 502, and a second peripheral area PA2 positioned on an outer side of the third pixel area 503 and the second pixel area 502. For convenience of description, it is assumed that the outer side and the notch NT of the substrate SUB are angled, but in another exemplary embodiment of the inventive concept, the outer side and the notch NT of the substrate SUB may be curved.

The first pixel area 501 may contact the second pixel area 502 and the first peripheral area PA1, and may be spaced apart from the third pixel area 503 and the second peripheral area PA2. The third pixel area 503 may contact the second pixel area 502 and the second peripheral area PA2, and may be spaced apart from the first pixel area 501 and the first peripheral area PA1. For example, the first and third pixel areas 501 and 503 may be spaced apart from each other by the notch NT. The first pixel area 501 may have a first width W1. The second pixel area 502 may have a second width W2 wider than the first width W1. The third pixel area 503 may have a third width W3 narrower than the second width W2. The third width W3 may be the same as the first width W1 or the third width W3 and the first width W1 may be different from each other.

The first scan driver 30 may be mounted in the first peripheral area PA1. In another exemplary embodiment of the inventive concept, only pad electrodes connected to the first scan driver 30 may be mounted in the first peripheral area PA1. In this case, the first scan driver 30 may be mounted on an external circuit board and may be electrically connected to the pad electrodes.

The second scan driver 40 may be mounted in the second peripheral area PA2. In another exemplary embodiment of the inventive concept, only pad electrodes connected to the second scan driver 40 may be mounted in the second peripheral area PA2. In this case, the second scan driver 40 may be mounted on an external circuit board and may be electrically connected to the pad electrodes.

The first pixel area 501 and the third pixel area 503 may include pixels connected to the same write scan line. Pixels positioned on the same horizontal line may be connected to the same write scan line, compensation scan line, bypass scan line, initialization scan line, and emission scan line. For example, pixels PX11, PX12, and PX1*p* in the uppermost row shown in FIG. 7 may be connected to the same write scan line GWL1, compensation scan line, bypass scan line, initialization scan line, and emission scan line. Here, p may be an integer greater than 0. In addition, for example, pixels PX51, PX52, and PX5*p* may be connected to the same write scan line GWL5, compensation scan line, bypass scan line, initialization scan line, and emission scan line. The number of pixels PX11, PX12, and PX1*p* connected to the write scan line GWL1 and the number of pixels PX51, PX52, and PX5*p* connected to the write scan line GWL5 may be the same. However, for example, when the outer side of the substrate SUB is curved, the number of pixels PX11, PX12 and PX1*p* and the number of pixels PX51, PX52, and PX5*p* may be different from each other.

Pixels PX91, PX92, PX9*s*, and PX9*q* of the second pixel area 502 may be connected to the same write scan line GWL9, compensation scan line, bypass scan line, initialization scan line, and emission scan line. In addition, pixels PX131, PX132, PX13*s*, and PX13*q* of the second pixel area 502 may be connected to the same write scan line GWL13, compensation scan line, bypass scan line, initialization scan line, and emission scan line.

The number of pixels PX91, PX92, PX9*s*, and PX9*q* connected to the same write scan line GWL9 in the second pixel area 502 may be greater than the number of pixels PX11, PX12, and PX1*p* connected to the same write scan line GWL1 in the first pixel area 501 and the third pixel area 503. In other words, q may be an integer greater than p. For example, as a width of the notch NT increases, a difference between q and p may increase.

The number of pixels PX11, PX51, PX91, and PX131 connected to the same data line DL1 in the first pixel area 501 and the second pixel area 502 may be greater than the number of pixels PX9*s* and PX13*s* connected to the same data line DLs in the second pixel area 502.

For convenience of description, in FIG. 7, the pixels PX11, PX51, PX91, and PX131 are successively connected to the data line DL1. However, additional pixels may be connected to the data line DL1 between the pixels PX11, PX51 PX91, and PX131. In addition, the data line DL1 may be further extended under the pixel PX131, and additional pixels may be further connected to the extended data line DL1 This will be described with reference to FIGS. 8 and 9. This description may be applied to other data lines DL2, DLs, and DLq.

Figure 8:
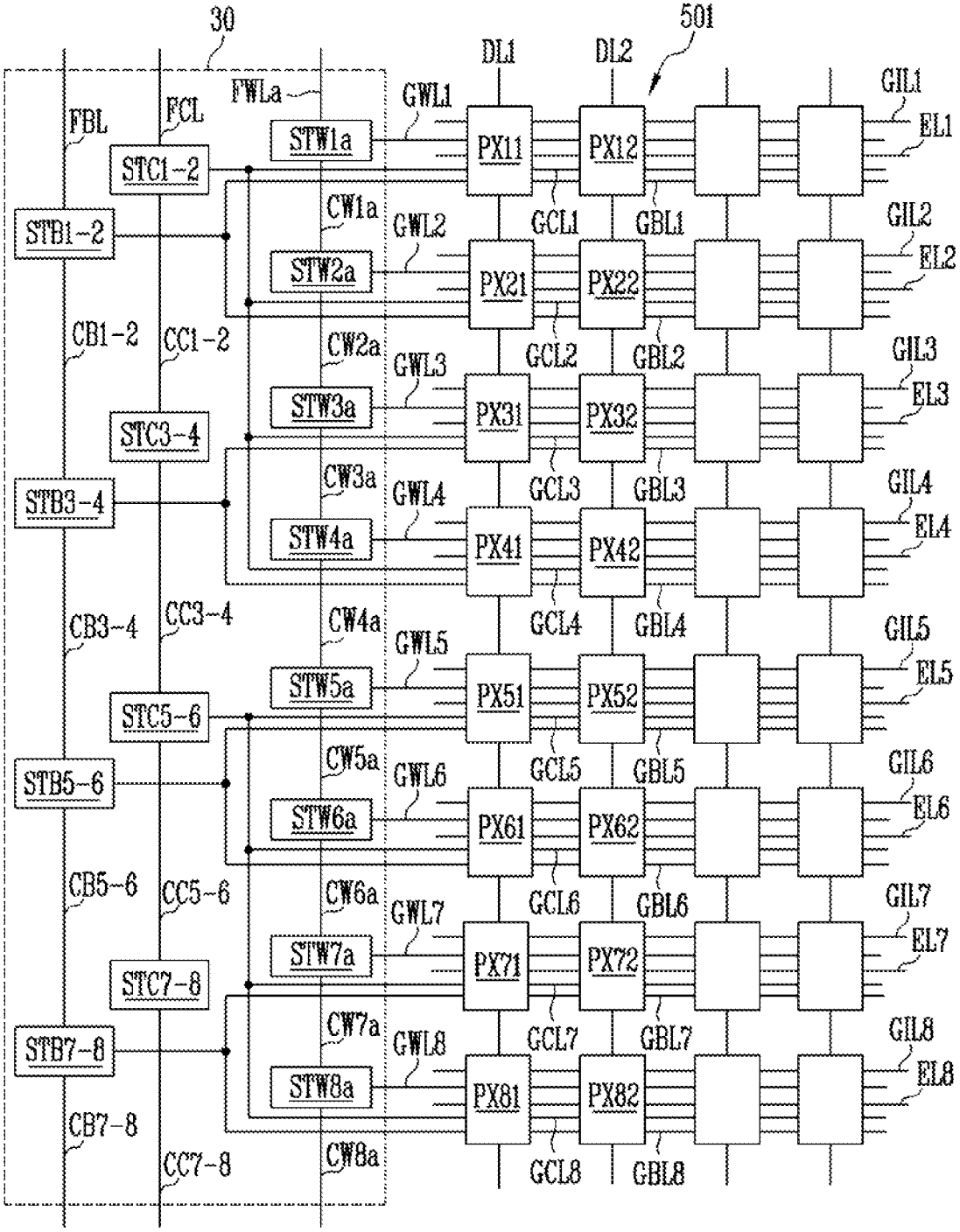
FIG. 8 is a diagram for describing a relationship between a first scan driver and a first pixel area, according to an exemplary embodiment of the inventive concept.
Figure 9:
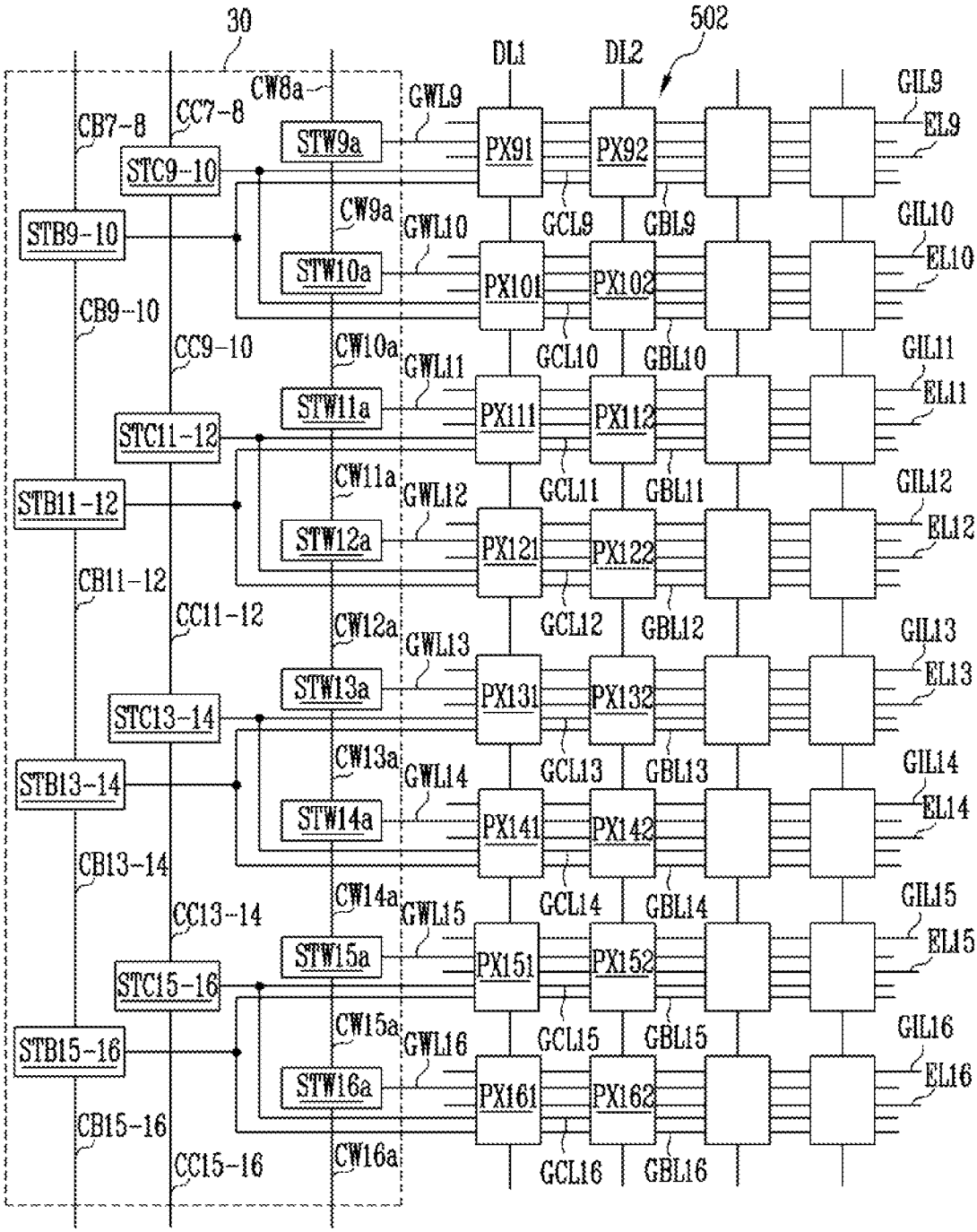
FIG. 9 is a diagram for describing a relationship between the first scan driver and a second pixel area, according to an exemplary embodiment of the inventive concept.
Figure 10:
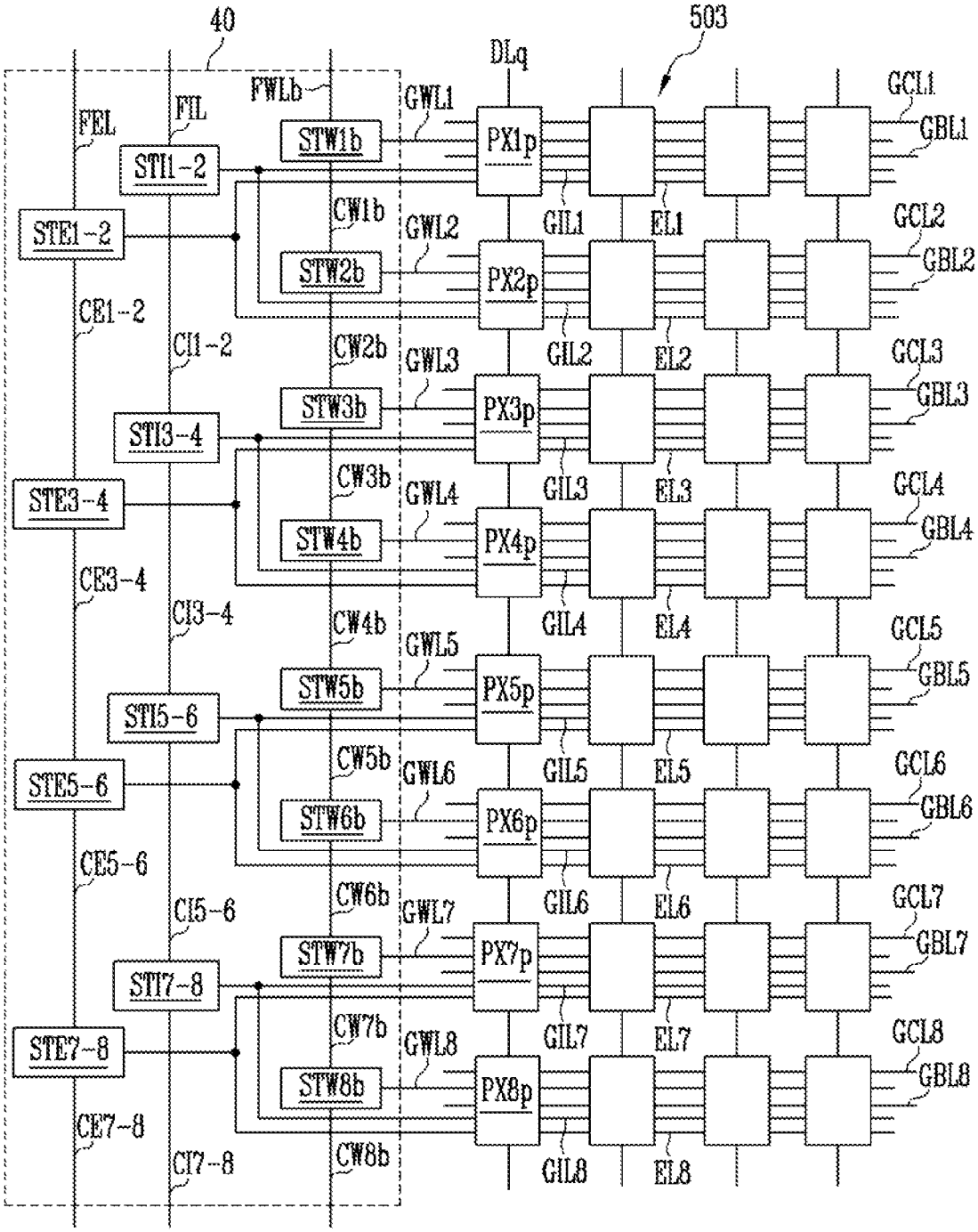
FIG. 10 is a diagram for describing a relationship between a second scan driver and a third pixel area, according to an exemplary embodiment of the inventive concept.
Figure 11:
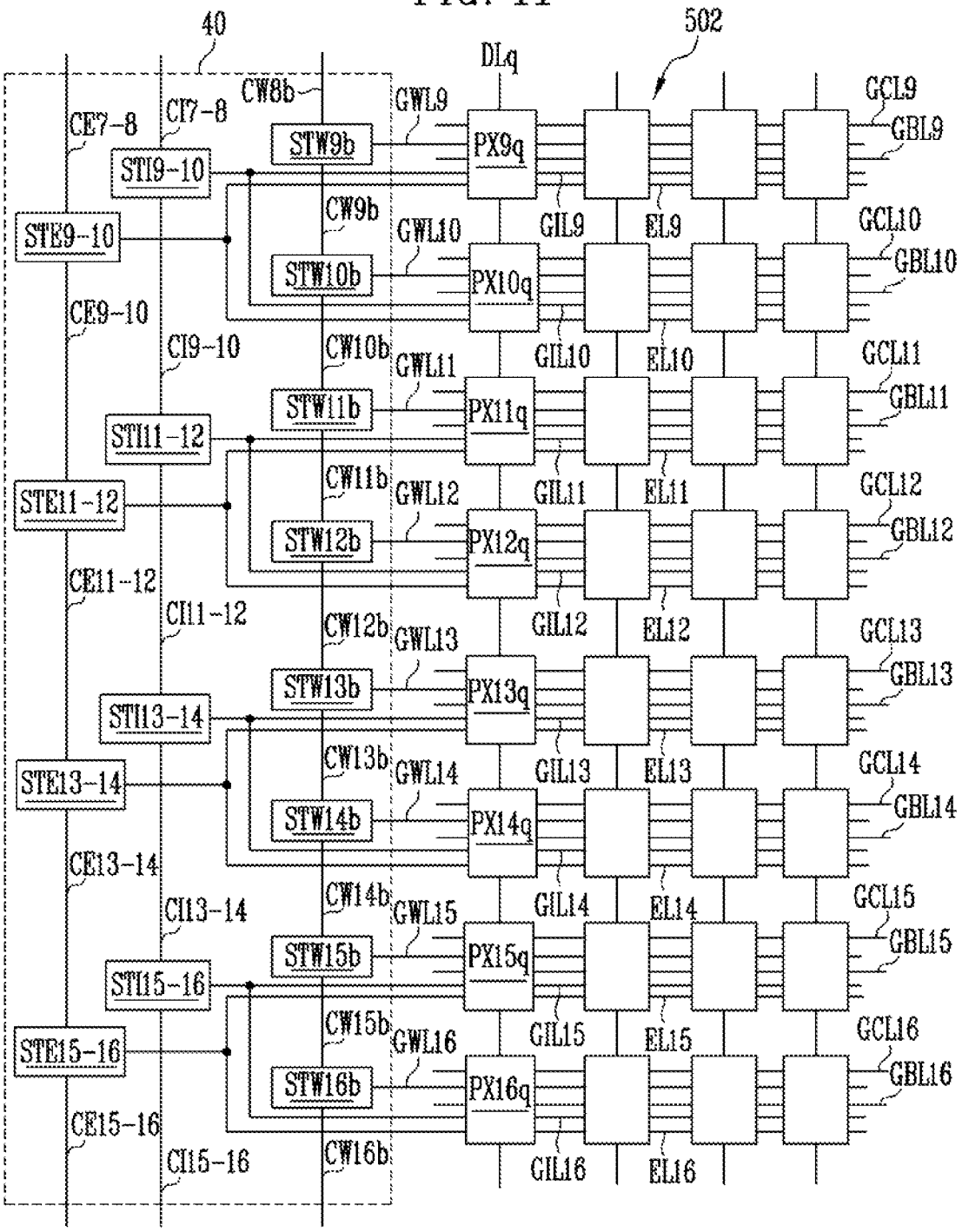
FIG. 11 is a diagram for describing a relationship between the second scan driver and the second pixel area, according to an exemplary embodiment of the inventive concept.

FIG. 8 is a diagram for describing a relationship between the first scan driver and the first pixel area, according to an exemplary embodiment of the inventive concept. FIG. 9 is a diagram for describing a relationship between the first scan driver and the second pixel area, according to an exemplary embodiment of the inventive concept. FIG. 10 is a diagram for describing a relationship between the second scan driver and the third pixel area, according to an exemplary embodiment of the inventive concept. FIG. 11 is a diagram for describing a relationship between the second scan driver and the second pixel area, according to an exemplary embodiment of the inventive concept.

In the first pixel area 501 and the third pixel area 503, the first pixels PX51, PX52, and PX5*p* may be connected to a first write scan line GWL5 and a first compensation scan line GCL5. Second pixels PX61, PX62, and PX6*p* may be connected to a second write scan line GWL6 and a second compensation scan line GCL6. Third pixels PX71, PX72, and PX7*p* may be connected to a third write scan line GWL7 and a third compensation scan line GCL7. Fourth pixels PX81, PX82, and PX8*p* may be connected to a fourth write scan line GWL8 and a fourth compensation scan line GCL8. The first pixel area 501 and the third pixel area 503 may further include pixels PX11 to PX1*p*, PX21 to PX2*p*, PX31 to PX3*p* and PX41 to PX4*p*.

In the second pixel area 502, fifth pixels PX91, PX92, PX9*s*, and PX9*q* may be connected to a fifth write scan line GWL9 and a fifth compensation scan line GCL9. Sixth pixels PX101, PX102, and PX10*q* may be connected to a sixth write scan line GWL10 and a sixth compensation scan line GCL10. Seventh pixels PX111, PX112, and PX11*q* may be connected to a seventh write scan line GWL11 and a seventh compensation scan line GCL11. Eighth pixels PX121, PX122, and PX12*q* may be connected to an eighth write scan line GWL12 and an eighth compensation scan line GCL12. The number of first pixels PX51, PX52, and PX5*p* may be less than the number of fifth pixels PX91, PX92, PX9*s*, and PX9*q*. The second pixel area 502 may further include pixels PX131 to PX13*q*, PX141 to PX14*q*, PX151 to PX15*q* and PX161 to PX16*q*.

The first compensation scan line GCL5, the second compensation scan line GCL6, the third compensation scan line GCL7, and the fourth compensation scan line GCL8 may be connected to a first node. The fifth compensation scan line GCL9 and the sixth compensation scan line GCL10 may be connected to a second node. The seventh compensation scan line GCL11 and the eighth compensation scan line GCL12 may be connected to a third node. In this case, the first node, the second node, and the third node may be electrically different nodes.

For example, an output terminal of a first compensation stage STC5-6 may be connected to the first node. A second compensation stage STC7-8 may be connected to the first compensation stage STC5-6 through a first compensation carry line CC5-6. A third compensation stage STC9-10 may be connected to the second compensation stage STC7-8 through a second compensation carry line CC7-8, and an output terminal thereof may be connected to the second node. The fourth compensation stage STC11-12 may be connected to the third compensation stage STC9-10 through a third compensation carry line CC9-10, and an output terminal thereof may be connected to the third node. The first scan driver 30 may further include compensation stages STC1-2, STC3-4, STC13-14 and STC15-16.

The first write scan line GWL5, the second write scan line GWL6, the third write scan line GWL7, the fourth write scan line GWL8, the fifth write scan line GWL9, the sixth write scan line GWL10, the seventh write scan line GWL11, and the eighth write scan line GWL12 may be connected to electrically different nodes.

For example, an output terminal of a first write stage STW5*a* may be connected to the first write scan line GWL5. A second write stage STW6*a* may be connected to the first write stage STW5*a* through a first write carry line CW5*a*, and an output terminal of the second write stage STW6*a* may be connected to the second write scan line GWL6. A third write stage STW7*a* may be connected to the second write stage STW6*a* through a second write carry line CW6*a*, and an output terminal of the third write stage STW7*a* may be connected to the third write scan line GWL7. A fourth write stage STW8*a* may be connected to the third write stage STW7*a* through a third write carry line CW7*a*, and an output terminal of the fourth write stage STW8*a* may be connected to the fourth write scan line GWL8.

A fifth write stage STW9*a* may be connected to the fourth write stage STW8*a* through a fourth write carry line CW8*a*, and an output terminal of the fifth write stage STW9*a* may be connected to the fifth write scan line GWL9. A sixth write stage STW10*a* may be connected to the fifth write stage STW9*a* through a fifth write carry line CW9*a*, and an output terminal of the sixth write stage STW10*a* may be connected to the sixth write scan line GWL10. A seventh write stage STW11*a* may be connected to the sixth write stage STW10*a* through a sixth write carry line CW10*a*, and an output terminal of the seventh write stage STW11*a* may be connected to the seventh write scan line GWL11. An eighth write stage STW12*a* may be connected to the seventh write stage STW11*a* through a seventh write carry line CW11*a*, and an output terminal of the eight write stage STW12*a* may be connected to the eighth write scan line GWL12. The first scan driver 30 may further include write stages STW1*a*-STW4*a* and STW13*a*-STW16*a*.

A first initialization stage STI5-6 may have an output terminal connected to the first pixels PX51, PX52, and PX5*p* through a first initialization scan line GIL5 and connected to the second pixels PX61, PX62, and PX6*p* through a second initialization scan line GIL6. For example, the line connecting the first initialization stage STI5-6 to the first pixel PX5*p* may have a branch connected to the second pixel PX6*p*. A second initialization stage STI7-8 may have an output terminal connected to the third pixels PX71, PX72, and PX7*p* through a third initialization scan line GIL7 and connected to the fourth pixels PX81, PX82, and PX8*p* through a fourth initialization scan line GIL8. A third initialization stage STI9-10 may have an output terminal connected to the fifth pixels PX91, PX92, PX9*s*, and PX9*q* through a fifth initialization scan line GIL9 and connected to the sixth pixels PX101, PX102, and PX10*q* through a sixth initialization scan line GIL10. A fourth initialization stage STI1-12 may have an output terminal connected to the seventh pixels PX111, PX112, and PX11*q* through a seventh initialization scan line GIL11 and connected to the eighth pixels PX121, PX122, and PX12*q* through an eighth initialization scan line GIL12.

The second initialization stage STI7-8 may be connected to the first initialization stage STI5-6 through a first initialization carry line CI5-6. For example, the first initialization carry line CI5-6 may be directly connected o each of the second initialization stage STI7-8 and the first initialization stage STI5-6. The third initialization stage STI9-10 may be connected to the second initialization stage STI7-8 through a second initialization carry line CI7-8. The fourth initialization stage STI11-12 may be connected to the third initialization stage STI9-10 through a third initialization carry line CI9-10. The second scan driver 40 may further include initialization stages STI1-2, STI3-4, STI13-14 and STI15-16.

A first emission stage STE5-6 may have an output terminal connected to the first pixels PX51, PX52, and PX5*p* through a first emission scan line EL5 and connected to the second pixels PX61, PX62, and PX6*p* through a second emission scan line EL6. A second emission stage STET-8 may have an output terminal connected to the third pixels PX71, PX72, and PX7*p* through a third emission scan line EL7 connected to the fourth pixels PX81, PX82, and PX8*p* through a fourth emission scan line EL8. A third emission stage STE9-10 may have an output terminal connected to the fifth pixels PX91, PX92, PX9*s*, and PX9*q* through a fifth emission scan line EL9 and connected to the sixth pixels PX101, PX102, and PX10*q* through a sixth emission scan line EL10. A fourth emission stage STE11-12 may have an output terminal connected to the seventh pixels PX111, PX112, and PX11*q* through a seventh emission scan line EL11 and connected to the eighth pixels PX121, PX122, and PX12*q* through an eighth emission scan line EL12.

The second emission stage STE7-8 may be connected to the first emission stage STE5-6 through a first emission carry line CE5-6. For example, the first emission carry line CE5-6 may be directly connected between the second emission stage STE7-8 and the first emission stage STE5-6. The third emission stage STE9-10 may be connected to the second emission stage STE7-8 through a second emission carry line CE7-8. The fourth emission stage STE11-12 may be connected to the third emission stage STE9-10 through a third emission carry line CE9-10. The second scan driver 40 may further include emission stages STE1-2, STE-4, STE13-14 and STE15-16.

A first bypass stage STB5-6 may have an output terminal connected to the first pixels PX51, PX52, and PX5*p* through a first bypass scan line GBL5 and connected to the second pixels PX61, PX62, and PX6*p* through a second bypass scan line GBL6. A second bypass stage STB7-8 may have an output terminal connected to the third pixels PX71, PX72, and PX7*p* through a third bypass scan line GBL7 and connected to the fourth pixels PX81, PX82, and PX8*p* through a fourth bypass scan line GBL8. A third bypass stage STB9-10 may have an output terminal connected to the fifth pixels PX91, PX92, PX9*s*, and PX9*q* through a fifth bypass scan line GBL9 and connected to the sixth pixels PX101, PX102, and PX10*q* through a sixth bypass scan line GBL10. A fourth bypass stage STB11-12 may have an output terminal connected to the seventh pixels PX111, PX112, and PX11*q* through a seventh bypass scan line GBL11 and connected to the eighth pixels PX121, PX122, and PX12*q* through an eighth bypass scan line GBL12.

The second bypass stage STB7-8 may be connected to the first bypass stage STB5-6 through a first bypass carry line CB5-6. For example, the first bypass carry line CB5-6 may be directly connected between the second bypass stage STB7-8 and the first bypass stage STB5-6. The third bypass stage STB9-10 may be connected to the second bypass stage STB7-8 through a second bypass carry line CB7-8. The fourth bypass stage STB11-12 may be connected to the third bypass stage STB9-10 through a third bypass carry line CB9-10. The first scan driver 30 may further include bypass stages STB1-2, STB3-4, STB13-14 and STB15-16.

Other stages and pixels also have a similar structure, and thus repetitive description is omitted. However, in the first scan driver 30, since there is no previous write stage, the write stage STW1*a* may receive the write start signal through a write start line FWLa other than the write carry line. Since there is no previous compensation stage, the compensation stage STC1-2 may receive the compensation start signal through a compensation start line FCL other than the compensation carry line. Since there is no previous bypass stage, the bypass stage STB1-2 may receive a bypass start signal through a bypass start line FBL other than the bypass carry line.

In addition, in the second scan driver 40, since there is no previous write stage, the write stage STW1*b* may receive the write start signal through a write start line FWLb other than the write carry line. Since there is no previous initialization stage, the initialization stage STI1-2 may receive the initialization start signal through an initialization start line FIL other than the initialization carry line. Since there is no previous emission stage, the emission stage STE1-2 may receive the emission stop signal through an emission stop line FEL other than the emission carry line.

According to an exemplary embodiment of the inventive concept shown in FIGS. 7-11, the display device may include first pixels PX51 . . . connected to a first write scan line GWL5 and a first compensation scan line GCL5; second pixels PX61 . . . connected to a second write scan line GWL6 and a second compensation scan line GCL6; third pixels PX71 . . . connected to a third write scan line GWL7 and a third compensation scan line GCL7; fourth pixels PX81 . . . connected to a fourth write scan line GWL8 and a fourth compensation scan line GCL8; fifth pixels PX91 . . . connected to a fifth write scan line GWL9 and a fifth compensation scan line GCL9; sixth pixels PX101 . . . connected to a sixth write scan line GWL10 and a sixth compensation scan line GCL10; seventh pixels PX111 . . . connected to a seventh write scan line GWL11 and a seventh compensation scan line GCL11; and eighth pixels PX121 . . . connected to an eighth write scan line GWL12 and an eighth compensation scan line GCL12.

As shown in FIG. 7, the number of the first pixels PX51 is less than the number of the fifth pixels PX91 . . . . As shown in FIG. 8, the first compensation scan line GCL5, the second compensation scan line GCL6, the third compensation scan line GCL7, and the fourth compensation scan line GCL8 are connected to a first node (e.g., at the output of STC5-6), the fifth compensation scan line GCL9 and the sixth compensation scan line GCL10 are connected to a second node (e.g., at the output of STC9-10), the seventh compensation scan line GCL11 and the eighth compensation scan line GCL12 are connected to a third node (e.g., at the output of STC11-12), and the first node, the second node, and the third node are different nodes.

Figure 12:
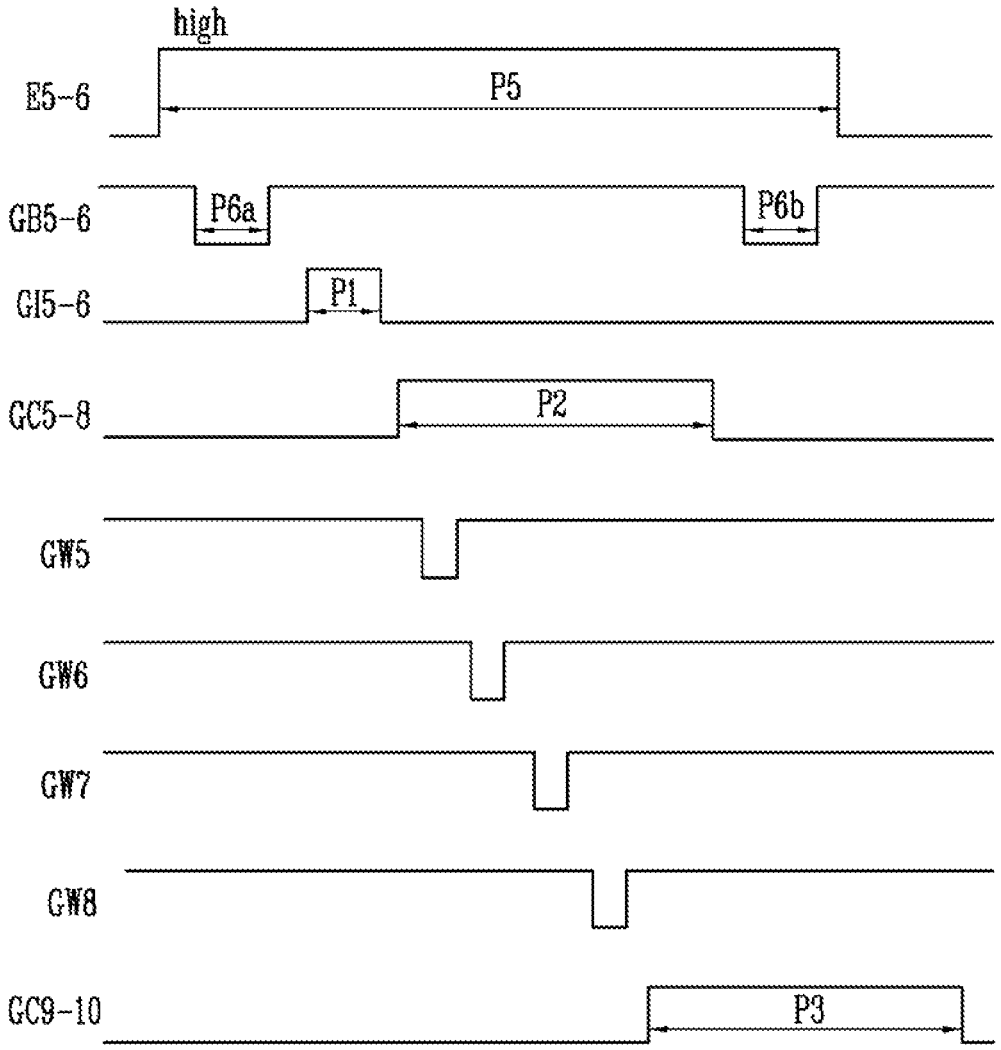
FIGS. 12 and 13 are diagrams for describing a driving method of the first pixel area and the second pixel area, according to an exemplary embodiment of the inventive concept.
Figure 13:
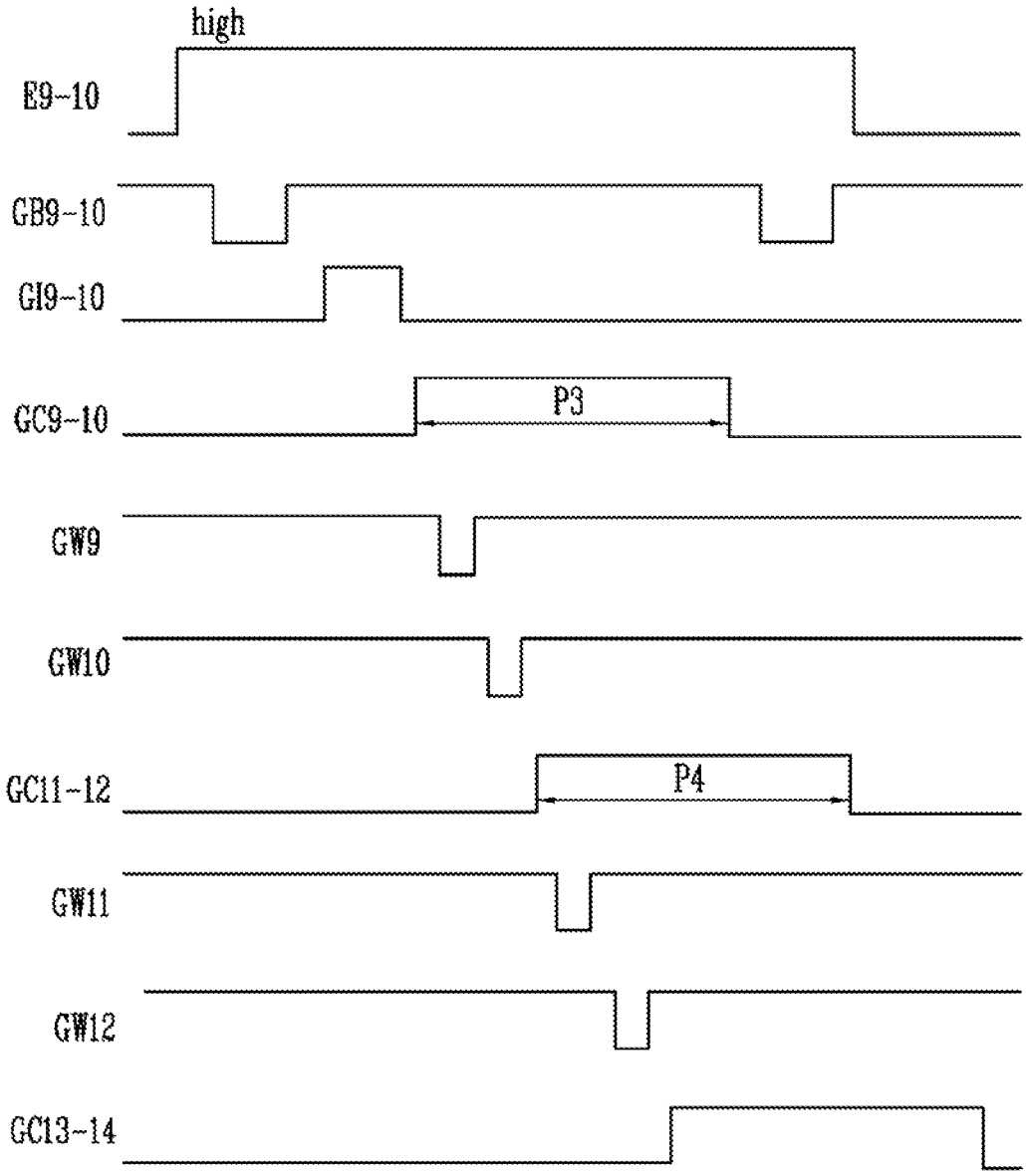

FIGS. 12 and 13 are diagrams for describing a driving method of the first pixel area and the second pixel area, according to an exemplary embodiment of the inventive concept.

During a first period P1, the first initialization stage STI5-6 may apply an initialization scan signal GI5-6 of a turn-on level to the first initialization scan line GIL5 and the second initialization scan line GIL6.

During a second period P2 after the first period P1, the first compensation stage STC5-6 may apply a compensation scan signal GC5-8 of a turn-on level to the first compensation scan line GCL5, the second compensation scan line GCL6, the third compensation scan line GCL7, and the fourth compensation scan line GCL8. The first compensation stage STC5-6 provides a compensation carry signal to the second compensation stage STC7-8 through the first compensation carry line CC5-6.

The second compensation stage STC7-8 does not supply a compensation scan signal of a turn-on level since there is no compensation scan line connected thereto despite reception of the compensation carry signal. The second compensation stage STC7-8 provides the compensation carry signal to the third compensation stage STC9-10 through the second compensation carry line CC7-8.

During a third period P3, the third compensation stage STC9-10 may apply a compensation scan signal GC9-10 of a turn-on level to the fifth compensation scan line GCL9 and the sixth compensation scan line GCL10. The third compensation stage STC9-10 provides the compensation carry signal to the fourth compensation stage STC11-12 through the third compensation carry line CC9-10.

During a fourth period P4, the fourth compensation stage STC11-12 may apply a compensation scan signal GC11-12 of a turn-on level to the seventh compensation scan line GCL11 and the eighth compensation scan line GCL12. The fourth compensation stage STC11-12 provides a compensation carry signal to the fifth compensation stage STC13-14 through the fourth compensation carry line CC11-12. Since operations of the fifth compensation stage STC13-14 and subsequent compensation stages are the same as described above, repetitive description is omitted.

According to the present embodiment, a period in which the second period P2 and the third period P3 overlap is shorter than a period in which the third period P3 and the fourth period P4 overlap. For example, during a period other than the third period P3 within the second period P2, the first write stages STW5*a* and STW5*b*, the second write stages STW6*a* and STW6*b*, the third write stage STW7*a* and STW7*b*, and the fourth write stages STW8*a* and STW8*b* may sequentially output write scan signals GW5, GW6, GW7 and GW8 of a turn-on level. For example, the write scan signals GW5, GW6, GW7, and GW8 may transition low during the second period P2 before the third period T3. On the other hand, during a period other than the fourth period P4 within the third period P3, the fifth write stages STW9*a* and STW9*b* and the sixth write stages STW10*a* and STW10*b* may sequentially output write scan signals GW9 and GW10 of a turn-on level. In this case, the write scan signals GW9 and GW10 transition low in the third period P3 before the fourth period P4.

According to the present embodiment, the compensation scan line of the first pixel area 501 and the third pixel area 503 simultaneously supply the compensation scan signal of the turn-on level to four pixel rows. In this case, the compensation scan line of the second pixel area 502 simultaneously supplies the compensation scan signal of the turn-on level to two pixel rows.

In another exemplary embodiment of the inventive concept, the compensation scan line of the first pixel area 501 and the third pixel area 503 may simultaneously supply the compensation scan signal of the turn-on level to u pixel rows. In this case, the compensation scan line of the second pixel area 502 may simultaneously supply the compensation scan signal of the turn-on level to v pixel rows. At this time, v may be an integer greater than 0. Herein, u may be an integer greater than v. In an exemplary embodiment of the inventive concept in which a supply period of the compensation carry signal is constant, u may be an integer multiple of v.

According to these exemplary embodiments of the inventive concept, a resistive-capacitive (RC) delay of the compensation scan signal may be increased in the first pixel area 501 and the third pixel area 503 in which the number of pixels in each pixel row is relatively small. Accordingly, the RC delay of the compensation scan signals may be matched in the first to third pixel areas 501, 502, and 503. Accordingly, a load matching capacitor for the compensation scan signals is not needed, and thus the size of a non-display area may be reduced.

During the fourth period P4, the seventh write stages STW11*a* and STW11*b* and the eighth write stages STW12*a* and STW12*b* may sequentially output write scan signals GW11 and GW12 of a turn-on level. In this case, the write scan signals GW11 and GW12 transition low in the fourth period P4.

During a fifth period P5, referring back to FIG. 12, the first emission stage STE5-6 may apply an emission scan signal E5-6 of a turn-off level to the first emission scan line EL5 and the second emission scan line EL6. The fifth period P5 may include the first period P1 and the second period P2.

During a sixth period P6*a* or P6*b*, the first bypass stage STB5-6 may apply a bypass scan signal GB5-6 of a turn-on level to the first bypass scan line GBL5 and the second bypass scan line GBL6. The sixth period P6*a* or P6*b* may overlap the fifth period P5, and may not overlap the first period P1 and the second period P2.

Figure 14:
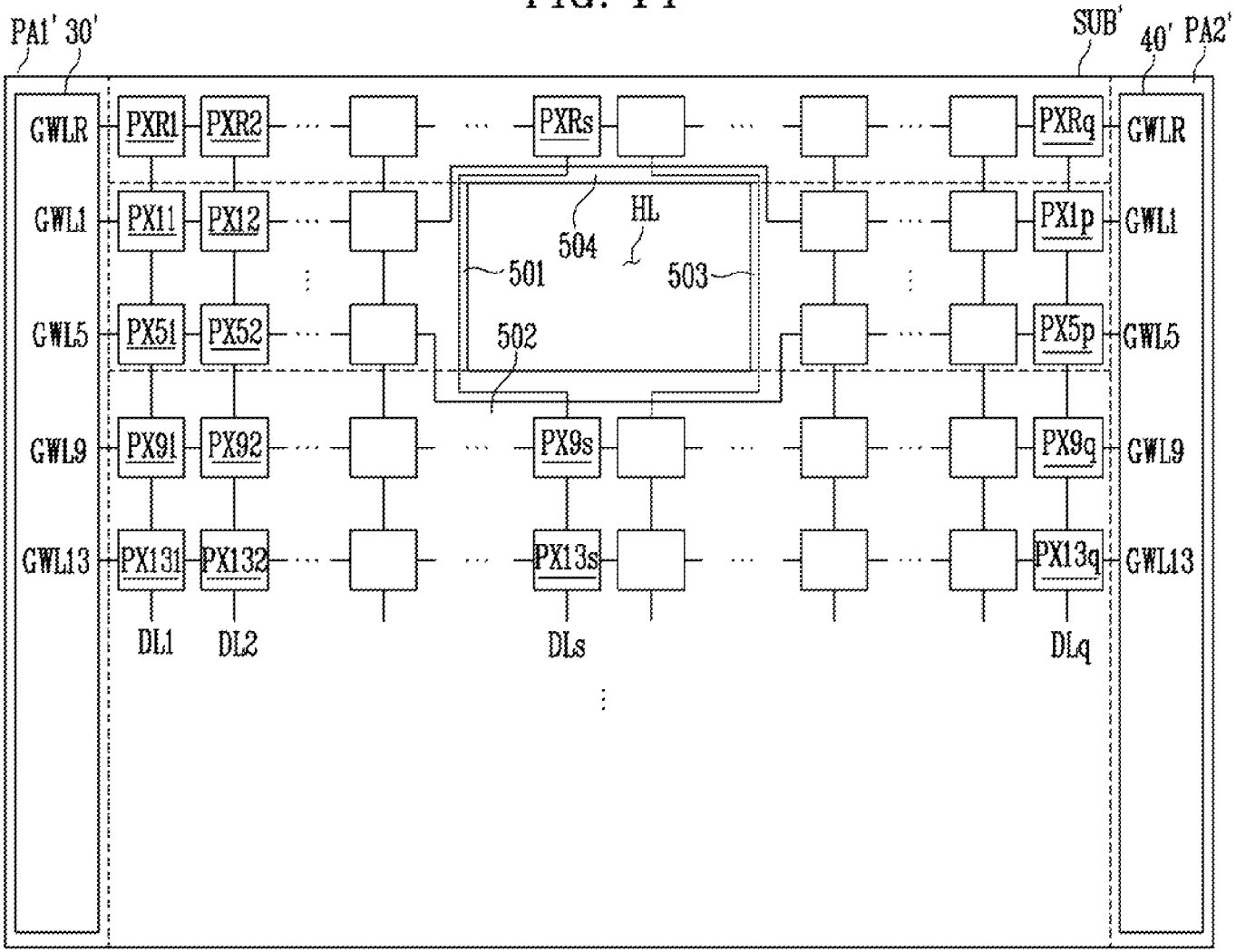
FIG. 14 is a diagram for describing a display device according to an exemplary embodiment of the inventive concept in which the substrate includes a hole.

FIG. 14 is a diagram for describing a display device according to an exemplary embodiment of the inventive concept in which the substrate includes a hole.

Referring to FIG. 14, the substrate SUB' is different from the substrate SUB of FIG. 7 in that the substrate SUB' includes a hole HL rather than the notch NT.

The substrate SUB' may further include a fourth pixel area 504. The fourth pixel area 504 may contact a first pixel area 501, a first peripheral area PA1', a third pixel area 503, and a second peripheral area PA2'. In addition, the fourth pixel area 504 may be spaced apart from the second pixel area 502. A width of the fourth pixel area 504 may be the same as a width of the second pixel area 502.

Pixels PXR1 PXR2, PXRs, and PXRq of the fourth pixel area 504 may be connected to the same write scan line GWLR, compensation scan line, bypass scan line, initialization scan line, and emission scan line.

The number of pixels PXR1, PXR2, PXRs, and PXRq connected to the same write scan line GWLR in the fourth pixel area 504 may be greater than the number of pixels PX11, PX12, and PX1*p* connected to the same write scan line GWL1 in the first pixel area 501 and the third pixel area 503. In other words, q may be an integer greater than p. For example, as a width of the hole HL increases, a difference between q and p may increase.

The number of pixels PX11, PX51, PX91, and PX131 connected to the same data line DL1 in the first pixel area 501 and the second pixel area 502 may be greater than the number of pixels PXRs, PX9*s*, and PX13*s* connected to the same data line DLs in the second pixel area 502 and the fourth pixel area 504.

All above-described embodiments may be applied to the embodiment of FIG. 14. For example, a connection relationship between the pixels PXR1 to PXRq of the fourth pixel area 504 and scan drivers 30' and 40' may be substantially the same as a connection relationship between the pixels PX91 to PX9*q* of the second pixel area 502 and the scan drivers 30 and 40.

Even when the notch NT and the hole HL are not present in the substrates SUB and SUB', a load matching that occurs due to a difference between the numbers of pixels included in the pixel rows, may be accomplished in accordance with exemplary embodiments of the inventive concept described above.

A display device according to an exemplary embodiment of the inventive concept is capable of distributing drivers and minimizing or removing a non-display area by minimizing or removing a load matching capacitor.

While the inventive concept has been described with reference to exemplary embodiments thereof, those skilled in the art will appreciate that various changes in form and details may be made thereto without departing from the spirit and scope of the inventive concept as set forth in the following claims.

What is claimed is:

1. A display device, comprising:

a plurality of compensation stages connected to a plurality of compensation scan lines, each of the plurality of compensation scan lines connected to different pixel rows; and a plurality of pixels, each of the plurality of pixels comprising a first transistor including a first electrode, a second electrode, and a gate electrode and a third transistor having a first electrode connected to the second electrode of the first transistor, a second electrode connected to the gate electrode of the first transistor, and a gate electrode connected to one of the plurality of compensation scan lines, wherein the plurality of compensation stages comprises first to fourth compensation stages, wherein the first compensation stage has an output terminal connected to P (an integer larger than 1) of the plurality of compensation scan lines, wherein the second compensation stage is connected to the first compensation stage through a first compensation carry line and has no compensation scan line connected thereto, wherein the third compensation stage is connected to the second compensation stage through a second compensation carry line and has an output terminal connected to Q (an integer larger than C) and smaller than P) of the plurality of compensation scan lines, wherein the fourth compensation stage is connected to the third compensation stage through a third compensation carry line and has an output terminal connected to R (an integer the same as Q) of the plurality of compensation scan lines, and wherein a number of pixels connected to each of P of the plurality of compensation scan lines is less than a number of pixels connected to each of Q of the plurality of compensation scan lines.

2. The display device according to claim 1, further comprising:

a plurality of write stages connected to a plurality of write scan lines, each of the plurality of write scan lines connected to different pixel rows, wherein each of the plurality of pixels further comprises a second transistor having a first electrode connected to a data line, a second electrode connected to the first electrode of the first transistor, and a gate electrode connected to one of the plurality of write scan lines.

3. The display device according to claim 2, wherein the plurality of pixels comprises:

first pixels connected to a first write scan line and a first compensation scan line;

second pixels connected to a second write scan line and a second compensation scan line;

third pixels connected to a third write scan line and a third compensation scan line;

fourth pixels connected to a fourth write scan line and a fourth compensation scan line;

fifth pixels connected to a fifth write scan line and a fifth compensation scan line;

sixth pixels connected to a sixth write scan line and a sixth compensation scan line;

seventh pixels connected to a seventh write scan line and a seventh compensation scan line; and eighth pixels connected to an eighth write scan line and an eighth compensation scan line, wherein the first compensation scan line, the second compensation scan line, the third compensation scan line, and the fourth compensation scan line are connected to a first node the same as the output terminal of the first compensation stage, wherein the fifth compensation scan line and the sixth compensation scan line are connected to a second node the same as the output terminal of the third compensation stage, and wherein the seventh compensation scan line and the eighth compensation scan line are connected to a third node the same as the output terminal of the fourth compensation stage.

4. The display device according to claim 3, wherein the first write scan line, the second write scan line, the third write scan line, the fourth write scan line, the fifth write scan line, the sixth write scan line, the seventh write scan line, and the eighth write scan lines are separated from each other.

5. The display device according to claim 4, wherein the plurality of write stages comprises:

a first write stage having an output terminal connected to the first write scan line;

a second write stage connected to the first write stage and having an output terminal connected to the second write scan line;

a third write stage connected to the second write stage and having an output terminal connected to the third write scan line;

a fourth write stage connected to the third write stage and having an output terminal connected to the fourth write scan line;

a fifth write stage connected to the fourth write stage and having an output terminal connected to the fifth write scan line;

a sixth write stage connected to the fifth write stage and having an output terminal connected to the sixth write scan line;

a seventh write stage connected to the sixth write stage and having an output terminal connected to the seventh write scan line; and an eighth write stage connected to the seventh write stage and having an output terminal connected to the eighth write scan line.

6. The display device according to claim 5, further comprising:

a first initialization stage having an output terminal connected to the first pixels and the second pixels;

a second initialization stage having an output terminal connected to the third pixels and the fourth pixels;

a third initialization stage having an output terminal connected to the fifth pixels and the sixth pixels; and a fourth initialization stage having an output terminal connected to the seventh pixels and the eighth pixels.

7. The display device according to claim 6, wherein the second initialization stage is connected to the first initialization stage, the third initialization stage is connected to the second initialization stage, and the fourth initialization stage is connected to the third initialization stage.

8. The display device according to claim 7, further comprising:

a first emission stage having an output terminal connected to the first pixels and the second pixels;

a second emission stage having an output terminal connected to the third pixels and the fourth pixels;

a third emission stage having an output terminal connected to the fifth pixels and the sixth pixels; and a fourth emission stage having an output terminal connected to the seventh pixels and the eighth pixels.

9. The display device according to claim 8, wherein the second emission stage is connected to the first emission stage, the third emission stage is connected to the second emission stage, and the fourth emission stage is connected to the third emission stage.

10. The display device according to claim 9, further comprising:

a first bypass stage having an output terminal connected to the first pixels and the second pixels;

a second bypass stage having an output terminal connected to the third pixels and the fourth pixels;

a third bypass stage having an output terminal connected to the fifth pixels and the sixth pixels; and a fourth bypass stage having an output terminal connected to the seventh pixels and the eighth pixels.

11. The display device according to claim 10, wherein the second bypass stage is connected to the first bypass stage, the third bypass stage is connected to the second bypass stage, and the fourth bypass stage is connected to the third bypass stage.

12. The display device according to claim 11, wherein each of the plurality of pixels further comprises:

a fourth transistor having a first electrode connected to a first initialization line, a second electrode connected to the gate electrode of the first transistor, and a gate electrode connected to an initialization scan line;

a fifth transistor having a first electrode connected to a first power line, a second electrode connected to the first electrode of the first transistor, and a gate electrode connected to an emission scan line;

a sixth transistor having a first electrode connected to the second electrode of the first transistor, a second electrode, and a gate electrode connected to an emission scan line;

a capacitor having a first electrode connected to the first power line, and a second electrode connected to the gate electrode of the first transistor; and a light emitting diode having an anode connected to the second electrode of the sixth transistor and a cathode connected to a second power line.

13. The display device according to claim 12, wherein each of the plurality of pixels further comprises:

a seventh transistor having a first electrode connected to the anode of the light emitting diode, a second electrode connected to a second initialization line, and a gate electrode connected to a bypass scan line; and an eighth transistor having a first electrode connected to a third power line, a second electrode connected to the first electrode of the first transistor, and a gate electrode connected to the bypass scan line.

14. The display device according to claim 11, wherein the first initialization stage applies an initialization scan signal of a turn-on level to a first initialization scan line and a second initialization scan line during a first period, wherein the first initialization scan line connects the first initialization stage to the first pixels and the second initialization scan line connects the first initialization stage to the second pixels, and the first compensation stage applies a compensation scan signal of the turn-on level to the first compensation scan line, the second compensation scan line, the third compensation scan line, and the fourth compensation scan line during a second period after the first period.

15. The display device according to claim 14, wherein the third compensation stage applies a compensation scan signal of the turn-on level to the fifth compensation scan line and the sixth compensation scan line during a third period, and the first write stage, the second write stage, the third write stage, and the fourth write stage sequentially output write scan signals of the turn-on level during a period other than the third period within the second period.

16. The display device according to claim 15, wherein the fourth compensation stage applies a compensation scan signal of the turn-on level to the seventh compensation scan line and the eighth compensation scan line during a fourth period, the fifth write stage and the sixth write stage sequentially output write scan signals of the turn-on level during a period other than the fourth period within the third period, and the seventh write stage and the eighth write stage sequentially output write scan signals of the turn-on level during the fourth period.

17. The display device according to claim 16, wherein the first emission stage applies an emission scan signal of a turn-off level to a first emission scan line and a second emission scan line during a fifth period, wherein the first emission scan line connects the first emission stage to the first pixels and the second emission scan line connects the first emission stage to the second pixels, the fifth period includes the first period and the second period, the first bypass stage applies a bypass scan signal of the turn-on level to a first bypass scan line and a second bypass scan line during a sixth period, wherein the first bypass scan line connects the first bypass stage to the first pixels and the second bypass scan line connects the first bypass stage to the second pixels, the sixth period overlaps the fifth period and does not overlap the first period and the second period, and a period in which the second period and the third period overlap is shorter than a period in which the third period and the fourth period overlap.

* * * * *